US007972759B2

(12) United States Patent
Fujimoto et al.

(10) Patent No.: US 7,972,759 B2
(45) Date of Patent: Jul. 5, 2011

(54) ELECTROPHOTOGRAPHIC IMAGE-RECEIVING SHEET, METHOD FOR PRODUCING THE SAME AND IMAGE FORMING METHOD

(75) Inventors: Shinji Fujimoto, Shizuoka (JP); Ashita Murai, Kanagawa (JP); Yasutomo Goto, Shizuoka (JP); Yoshio Tani, Kanagawa (JP); Masuo Murakami, Kyoto (JP); Tetsuo Matsumoto, Osaka (JP)

(73) Assignee: FUJIFILM Corporation, Tokyo (JP)

( * ) Notice: Subject to any disclaimer, the term of this patent is extended or adjusted under 35 U.S.C. 154(b) by 997 days.

(21) Appl. No.: 11/778,808

(22) Filed: Jul. 17, 2007

(65) Prior Publication Data

US 2008/0057419 A1 Mar. 6, 2008

(30) Foreign Application Priority Data

Aug. 30, 2006 (JP) ..... 2006-233513

(51) Int. Cl.
*G03G 5/00* (2006.01)

(52) U.S. Cl. ..... 430/124.53; 430/124.54; 428/480

(58) Field of Classification Search ..... 430/124.53, 430/124.54; 428/480
See application file for complete search history.

(56) References Cited

U.S. PATENT DOCUMENTS

| | | | | |
|---|---|---|---|---|
| 6,051,355 | A * | 4/2000 | Van Thillo et al. | 430/109.4 |
| 2008/0108501 | A1 | 5/2008 | Fujimoto et al. | |

FOREIGN PATENT DOCUMENTS

| | | | |
|---|---|---|---|
| JP | 2005-92097 | A | 4/2005 |
| JP | 2005-99123 | A | 4/2005 |
| JP | 2005-181881 | A | 7/2005 |
| JP | 2005-181883 | A | 7/2005 |
| JP | 2006-103157 | A | 4/2006 |

OTHER PUBLICATIONS

Japanese Office Action dated Jul. 13, 2010 on corresponding Japanese Patent Application No. 2006-233513 English- language Translation.

* cited by examiner

*Primary Examiner* — Mark A Chapman
(74) *Attorney, Agent, or Firm* — Sughrue Mion, PLLC

(57) ABSTRACT

Provided are an electrophotographic image-receiving sheet that comprises a support, a toner image-receiving layer on at least one side of the support, wherein the toner image-receiving layer is formed from a coating liquid for the toner image-receiving layer and the coating liquid for the toner image-receiving layer comprises an aqueous dispersion that comprises a crystalline polymer, and an image forming method that employs the electrophotographic image-receiving sheet.

14 Claims, 3 Drawing Sheets

ELECTROPHOTOGRAPHIC IMAGE-RECEIVING SHEET, METHOD FOR PRODUCING THE SAME AND IMAGE FORMING METHOD

BACKGROUND OF THE INVENTION

1. Field of the Invention

The present invention relates to electrophotographic image-receiving sheets that have proper low-temperature toner fixability and excellent adhesion resistance and can provide high-gloss high-quality images, methods for producing the electrophotographic image-receiving sheets, and image forming methods using the electrophotographic image-receiving sheets.

2. Description of the Related Art

Electrophotographic processes are typically carried out under a dry condition with higher printing speed and may print on conventional papers such as regular papers and bond papers, therefore have been widely employed in copiers, printers of personal computers, etc. The electrophotographic image-receiving sheets, used in the electrophotographic processes, have at least a toner image-receiving layer on a support, and the toner image-receiving layer is produced by melting and extruding a thermoplastic resin composition on a support to form a layer, a coating liquid for a thermoplastic resin is coated on a support, for example. In recent years, a method for producing the toner image-receiving layer has been interested, in which a water-insoluble resin is employed in a form of aqueous dispersion of a thermoplastic polymer resin in view of minimum environmental load.

The thermoplastic resin of the toner image-receiving layer is typically an amorphous polymer that has a glass transition temperature Tg that is higher than the ambient temperature and lower by several tens degrees than the toner fixing temperature. Such an amorphous polymer may provide excellent adhesive properties with toner, but tends to suffer from adhesive problems such as coagulation of toner image-receiving layers while reserving and/or transporting in overlapped conditions due to higher adhesive force between toner image-receiving layers.

On the other hand, crystalline polymers have low adhesive forces at normal temperature even the glass transition temperature Tg is lower than 0° C. thus are free from adhesive problems between toner image-receiving layers, meanwhile tend to melt rapidly above their melting temperatures specific for the resins. As such, the crystalline polymers have potential features in terms of excellent preserving and fixing properties, which have been tried to apply to the electrophotographic image-receiving sheets.

Japanese Patent Application Laid-Open (JP-A) No. 2005-92097 discloses that a color electrophotographic sheet, of which the toner image-receiving layer being formed of a certain crystalline polyester, may embed toner images uniformly into the toner image-receiving layer at a fixing temperature lower than previous one, bring about high-quality images with smaller unevenness from paper surface, and also afford proper mechanical durability with respect to folding and/or bending at processing stages.

JP-A No. 2005-99123 discloses that an image support, having a light diffusion layer and a toner receiving layer on a base material in which the toner receiving layer being formed from a polyester resin of melted and mixed amorphous and crystalline polyester resins, may improve the mechanical strength and heat resistance and enhance the low temperature fixability.

However, the toner receiving layer is produced in a melting and extruding process, which leading to expensive production systems. Moreover, it is likely that the production process is energy-consuming, the production cost is expensive, and environmental load is significant. In addition, there is such a problem that the crystalline polymer tends to loss its crystallinity while the crystalline polymer and the amorphous polymer is heated, melted and mixed to form a film, which possibly leading to poor performance and insufficient gloss for photographic images depending on conditions and/or combinations.

JP-A Nos. 2005-181881 and 2005-181883 disclose that an electrophotographic sheet, of which the toner image-receiving layer contains an amorphous polymer and a crystalline polymer, may improve the adhesion resistance that is a defect for amorphous polymers as well as the adhesive properties with toner resins that are a defect for crystalline polymers, thus proper toner fixability and excellent adhesion resistance may be combined together with, and images may be formed with high gloss and high quality.

However, the amorphous polymer and the crystalline polymer are dissolved in an organic solvent, in which the both can dissolve, to prepare a coating liquid which being then coated and dried, thus suffering from a significant environmental load. In addition, there is such a problem that the crystalline polymer tends to loss its crystallinity while being coated and dried as a mixture, which possibly leading to poor performance depending on conditions and/or combinations. Moreover, high gloss images may be formed under higher fixing temperatures, however, the gloss tends to decrease and/or undesirable defects like nonuniform gloss tend to generate at border lines between images and non-image areas at lower fixing temperatures, thus it is difficult to form appropriate images.

As described above, prior literatures describe no more than melting and extruding processes or coating processes with organic solvents that are undesirable due to a significant environmental load, and no electrophotographic image-receiving sheets have been investigated in combination with aqueous dispersions of crystalline polymers. This is derived from that conventional crystalline polymers are hardly soluble in usual organic solvents and it is difficult to prepare an aqueous substance and/or a stable dispersion. The preparation of aqueous substance has been investigated as regards very limited crystalline polymers that are unsatisfactory for electrophotographic image-receiving sheets in view of their properties; that is, crystalline-polymer aqueous dispersions have not been applied substantially at all to electrophotographic image-receiving sheets heretofore.

BRIEF SUMMARY OF THE INVENTION

The present invention aims to provide electrophotographic image-receiving sheets that have proper low-temperature toner fixability and excellent adhesion resistance and can provide high-gloss high-quality images; methods for producing the electrophotographic image-receiving sheets through an aqueous coating step with less environmental load at processing, lower cost, and higher productivity; and image forming methods by use of the electrophotographic image-receiving sheets.

The problems in the prior art may be solved by the present invention.

In an aspect of the present invention, an electrophotographic image-receiving sheet is provided that comprises a support and a toner image-receiving layer on at least one side of the support, wherein the toner image-receiving layer is formed from a coating liquid for the toner image-receiving layer, and the coating liquid for the toner image-receiving layer comprises an aqueous dispersion that comprises a crystalline polymer.

Preferably, the toner image-receiving layer exhibits a phase separated structure; the aqueous dispersion of the crystalline polymer comprises a basic compound and water; and the crystalline polymer is a crystalline polyester resin.

Preferably, the crystalline polyester resin has a melting point of 50° C. to 110° C., a heat of crystal fusion of 60 J/g or more, and a crystallization temperature in the cooling stage of 30° C. or higher; the crystalline polymer has a carboxyl group and an acid value of 20 mg/KOH to 40 mg/KOH; the crystalline polyester resin is a condensation polymerization product of an acid and an alcohol, the acid is dodecanedioic acid, and the alcohol is ethylene glycol; and the toner image-receiving layer is formed from a coating liquid for toner image-receiving layer that comprises a crystalline polymer aqueous dispersion and an amorphous polymer aqueous dispersion.

Preferably, the amorphous polymer is an amorphous polyester resin; the mass ratio of the amorphous polymer to the crystalline polymer is 95:5 to 50:50 (amorphous polymer: crystalline polymer) in the toner image-receiving layer; the support comprises a raw paper and at least a polyolefin resin layer on both sides of the raw paper; and two or more layers of polyolefin resin exist at the front side to dispose the toner image-receiving layer, and the density of the outermost polyolefin resin layer at the distal site from the raw paper is lower than the density of polyolefin resin layer(s) other than the outermost polyolefin resin layer.

In another aspect of the present invention, a method for producing an electrophotographic image-receiving sheet is provided that comprises coating a liquid for a toner image-receiving layer on a support to form the toner image-receiving layer, wherein the liquid for the toner image-receiving layer comprises an aqueous dispersion of a crystalline polymer, a basic compound, and water.

Preferably, the crystalline polymer is a crystalline polyester resin.

In another aspect of the present invention, an image forming method is provided that comprises forming a toner image on an electrophotographic image-receiving sheet and smoothing the surface of the toner image, wherein the electrophotographic image-receiving sheet comprises a support and a toner image-receiving layer on at least one side of the support, and the toner image-receiving layer is formed from a coating liquid for the toner image-receiving layer, and the coating liquid for the toner image-receiving layer comprises an aqueous dispersion that comprises a crystalline polymer.

Preferably, the toner image is heated, pressed, and cooled, and the electrophotographic image-receiving sheet is peeled by use of an image surface-smoothing and fixing device that comprises a heating/pressing member, a belt, and a cooling unit.

The electrophotographic image-receiving sheet of the present invention comprises a support and a toner image-receiving layer on at least one side of the support, the toner image-receiving layer is formed from a coating liquid for the toner image-receiving layer, and the coating liquid for the toner image-receiving layer comprises an aqueous dispersion that comprises a crystalline polymer, therefore, high gloss and high quality images may be formed with proper low-temperature toner fixability and excellent adhesion resistance.

In addition, the inventive electrophotographic image-receiving sheet may exhibit proper low-temperature toner fixability, thus high gloss and high quality images may be easily formed with less undesirable nonuniform gloss generating at border lines between images and non-image areas even under fixing with less energy consumption.

In addition, the inventive electrophotographic image-receiving sheet may exhibit excellent adhesion resistance, therefore, such problems may be avoided that electrophotographic image-receiving sheets adhere and resist to be separated each other between the toner image-receiving layers and/or adhesive traces remain at the sheet surface upon being forced to separate, even when the sheets are reserved or transported for a long period under higher temperatures and loads.

The inventive method for producing an electrophotographic image-receiving sheet comprises coating a liquid for a toner image-receiving layer on a support to form the toner image-receiving layer, wherein the liquid for the toner image-receiving layer comprises an aqueous dispersion of a crystalline polymer, a basic compound, and water. Such an aqueous coating may favorably lead to less environmental load and lower cost in the production processes of the electrophotographic image-receiving sheets.

The inventive image forming method comprises forming a toner image on an electrophotographic image-receiving sheet and smoothing the surface of the toner image. The inventive image forming method employs the inventive electrophotographic image-receiving sheet, therefore, high quality images may be easily formed like prints of silver-salt photography with simple processing.

DETAILED DESCRIPTION OF THE INVENTION

Electrophotographic Image-Receiving Sheet

Figure 1:
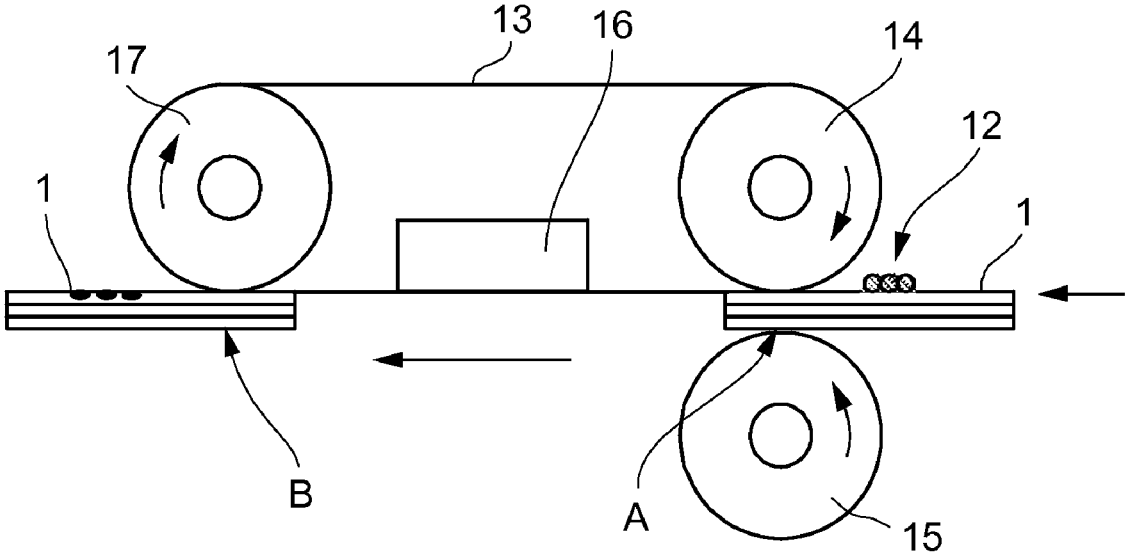
FIG. 1 is a schematic view that exemplarily shows an apparatus to fix images and to smooth the surface thereof available in the present invention.

The inventive electrophotographic image-receiving sheet comprises a support, a toner image-receiving layer on at least one surface of the support, and other optional layers such as a protective layer, a cushion layer, a charge-controlling or preventing layer, a reflective layer, a tint-controlling layer, a shelf stability-improving layer, an anti-adhesion layer, an anti-curling layer and a smoothing layer. Each of these layers may be a monolayer or a laminate.

Toner Image-Receiving Layer

The toner image-receiving layer is formed from a coating liquid for toner image-receiving layer that contains at least an aqueous dispersion of crystalline polymer, and the coating liquid for toner image-receiving layer contains an aqueous dispersion of amorphous polymer and other optional ingredients.

The aqueous dispersion of crystalline polymer contains at least a crystalline polymer, a basic compound, water and other optional ingredients.

The aqueous dispersion of amorphous polymer contains at least an amorphous polymer, water and other optional ingredients.

The amorphous polymer and the crystalline polymer refer to those defined by the following method.

A polymer is heated from room temperature to 320° C. in nitrogen atmosphere and is allowed to stand under the condition for 10 minutes. Then the polymer is rapidly cooled to about room temperature, immediately followed by heating from room temperature to 320° C. at a rate of 5° C./min by use of a differential scanning calorimeter (DSC) thereby to obtain an endothermic curve on the basis of crystal fusion. When an exothermic peak (crystallization peak) is observed in the endothermic curve, the polymer is defined as a crystalline polymer, and when no peak is observed, the polymer is defined as an amorphous polymer.

Crystalline Polymer

The crystalline polymer may be properly selected depending on the application; preferably, the polymer is thermoplastic resins in view of productivity etc. Examples of the crystalline polymer include crystalline polyester resins such as polyethylene terephthalate, polyethylene-2,6-naphthalate, polypropylene terephthalate and polybutylene terephthalate; polyolefin resins such as polyethylene and polypropylene; polyamide resins, polyether resins, polyester amide resins, polyether ester resins, polyvinyl alcohol resins, polyester methacrylate resins and copolymers thereof. These may be used alone or in combination. Among these, crystalline polyester resins are particularly preferable from the viewpoint of moderate melting points adequate for electrophotographic application, higher freedom degree in structural selection and steep modulus slope around their melting points.

It is necessary in the present invention that the toner image-receiving layer is formed from an aqueous dispersion of a crystalline polymer.

In cases where the crystalline polymer is other than aqueous dispersion, the production process of the toner image-receiving layer requires a large amount of energy for melting the materials in the melting and extruding processed and the production systems are exaggerative. In cases of coating processes using organic solvents that are environmentally harmful, the environmental load is significant and large scale systems are also necessary for collecting the organic solvent. In cases of melting and extruding processes or coating processes using organic solvents that involve melting or dissolving the crystalline polymer, the step to make compatible the crystalline polymer with other additives may diminish the crystallinity even after cooling and drying/solidifying again. As a result, the toner image-receiving layer may lose the sharp-melting property, generate easily blocking and/or cause adhesion in the production processes.

The melting point Tm of the crystalline polymer is preferably 50° C. to 110° C., more preferably 60° C. to 90° C. When the melting point of the crystalline polymer is above 110° C., the toner fixability may be low, the glossiness may be insufficient, the image quality may be deteriorated due to edge voids, and/or images may crack at folding. On the other hand, when the melting point of the crystalline polymer is below 50° C., the electrophotographic image-receiving sheet may generate blocking, induce adhesion with production lines, cause problems in the production and/or generate jamming due to low transportability in image forming apparatuses.

It is also preferred in the present invention that the resulting toner image-receiving layer has a phase separated structure. The phase separated structure may allow the crystalline polymer to easily maintain the crystallinity, the toner image-receiving layer may easily represent the sharp-melting property, the blocking may be prevented and the low-temperature fixability may easily generate.

The phase separated structure of the toner image-receiving layer may be determined by way of heating the toner image-receiving layer from room temperature to 320° C. at a rate of 5° C./min by use of a differential scanning calorimeter (DSC) and observing whether or not the endothermic curve appears on the basis of crystal fusion. The phase separated structure formed from the aqueous dispersion of the crystalline polymer may also be determined by observing grain boundaries between approximately circular non-aqueous phase structure of the crystalline polymer and the other phase structure at a cross section of the toner image-receiving layer by use of a scanning electron microscope or a transmission electron microscope.

Crystalline Polyester Resin

The crystalline polyester resin may be prepared by a condensation polymerization between a polybasic acid and a polyvalent alcohol, and may contain other optional ingredients.

The polybasic acid may be properly selected depending on the application; examples thereof include aliphatic polybasic acids, aromatic polybasic acids and cycloaliphatic polybasic acids. More specifically, the aliphatic polybasic acids are exemplified by saturated dicarboxylic acids such as oxalic acid, succinic anhydride, succinic acid, adipic acid, azelaic acid, sebacic acid, dodecanedioic acid, arachidionic acid and hydrogenated dimer acid; unsaturated aliphatic dicarboxylic acids such as fumaric acid, maleic acid, maleic anhydride, itaconic acid, itaconic anhydride, citraconic acid, citraconic anhydride and dimer acid. The aromatic polybasic acids are exemplified by aromatic dicarboxylic acids such as terephthalic acid, isophthalic acid, orthophthalic acid, naphthalenedicarboxylic acid and biphenyldicarboxylic acid. The cycloaliphatic polybasic acids are exemplified by cycloaliphatic dicarboxylic acids such as 1,4-cyclohexanedicarboxylic acid, 1,3-cyclohexanedicarboxylic acid, 1,2-cyclohexanedicarboxylic acid, 2,5-norbornenedicarboxylic acid, 2,5-norbornenedicarboxylic anhydride, tetrahydrophthalic acid and tetrahydrophthalic anhydride. These may be used alone or in combination. Among these, dodecanedioic acid, sebacic acid, succinic acid and terephthalic acid are preferable in particular.

The polybasic acids are preferably selected from the aliphatic polybasic acids in view of lower melting points and higher crystallinity. The content of the aliphatic polybasic acids in the total acids of the crystalline polyester resin is preferably 60% by mole or more in order to enhance crystallinity, chemical resistance and water resistance of the resulting films, and more preferably 75% by mole or more in order to enhance crystallization rate.

The polyvalent alcohols may be properly selected depending on the application; examples thereof include aliphatic glycols, cycloaliphatic glycols and ether bond-containing glycols. More specifically, the aliphatic glycols are exemplified by ethylene glycol, 1,2-propylene glycol, 1,3-propanediol, 1,4-butanediol, 2-methyl-1,3-propanediol, 1,5-pentanediol, neopentyl glycol, 1,6-hexanediol, 3-methyl-1,5-pentanediol, 1,9-nonanediol and 2-ethyl-2-butylpropanediol. The cycloaliphatic glycols are exemplified by 1,4-cyclohexanedimethanol. The ether bond-containing glycols are exemplified by diethylene glycol, triethylene glycol, dipropylene glycol, polyethylene glycol, polypropylene glycol and polytetramethylene glycol, and those glycols that are prepared by adding from one to several moles of ethylene oxide or propylene oxide to two phenolic hydroxide groups of bisphenols e.g. 2,2-bis(4-hydroxyethoxyphenyl)propane. Among these, ethylene glycol and 1,4-butanediol are preferable in order to enhance crystallinity, water resistance and chemical resistance.

A part of the polybasic acids or the polyvalent alcohols may contain those of trivalent or more. The polybasic acids of trivalent or more are exemplified by trimellitic acid, trimellitic anhydride, pyromellitic acid, pyromellitic anhydride, benzophenone tetracarboxylic acid, benzophenone tetracarboxylic anhydride, trimesic acid, ethyleneglycolbis(anhydrotrimellitate), glycerol tris(anhydrotrimellitate) and 1,2,3,4-butanetetracarboxylic acid. The polyvalent alcohols of trivalent or more are exemplified by glycerin, trimethylolethane, trimethylolpropane and pentaerythritol. The amount of the polybasic acids or the polyvalent alcohols of trivalent or more is preferably 10% by mole or less, more preferably 5% by mole or less, based on the total acids or total alcohols of the crystalline polyester resins in view of well-balancing the sharp-melting property i.e. low temperature fixability and the adhesion resistance.

The acid component of the crystalline polyester resin may be mono-carboxylic acids or ester derivatives thereof having higher boiling points such as lauric acid, myristic acid, parmitic acid, stearic acid, oleic acid, linoleic acid, linolenic acid, benzoic acid, p-tert-butylbenzoic acid, cyclohexanoic acid and 4-hydroxyphenylstearic acid. The alcohol component of the polyester resin may be monoalcohols having higher boiling points such as stearyl alcohol and 2-phenoxyethanol. The content of the mono-carboxylic acids or the monoalcohols is preferably no more than 5% by mole based on total acid or alcohol components in the polyester resin in view of preventing the cracking of the resulting image-receiving layers.

The additional component of the polyester resin may be hydroxycarboxylic acids such as γ-butyl lactone, ϵ-butyl lactone, lactic acid, β-hydroxybutyric acid and p-hydroxybenzoic acid.

The polyester resin may be properly produced by conventional methods; for example, (a) entire monomers undergo an esterification reaction at 180° C. to 250° C. for about 2.5 to 10 hours under an inert atmosphere, followed by condensation polymerization in the presence of an ester-exchange-reaction catalyst at 220° C. to 280° C. under a reduced pressure of 133 Pa or less till a desirable molecular mass being obtained thereby to prepare a polyester resin; (b) the condensation polymerization is stopped before the desirable molecular mass being obtained, then the reactant is mixed with a chain-extending agent selected from epoxy, isocyanate, bisoxazoline compounds etc. and allowed to react for a short period in order to increase the molecular mass; or (c) the condensation polymerization is continued till the molecular mass exceeds the desired level, then a monomer is added to the reactant and the mixture undergoes a depolymerization reaction at normal pressure or under pressurization in an inert atmosphere thereby to prepare a polyester resin with an intended molecular mass.

It is also preferable that the carboxyl groups of the polyester resin exist at the ends of resin molecules rather than in resin skeletons in order to improve the water resistance and chemical resistance of the resulting films.

In order to produce the polyester resin without undesirable side reactions and/or gelatinization, such processes may be employed as a trivalent or more polybasic acid or an ester-forming derivative thereof is added at initiating the condensation polymerization or a polybasic acid anhydride is added immediately before stopping the condensation polymerization in the process (a) described above; a low-molecular mass polyester resin, of which the chain ends being mostly carboxyl groups, is polymerized by action of a chain extender in the process (b) described above; a polybasic acid or an ester-forming derivative thereof is employed as a depolymerizing agent in the process (c) described above; or combinations of these processes.

The melting point of the crystalline polyester resin is preferably 50° C. to 110° C., more preferably 60° C. to 100° C. In cases where the melting point is below 50° C., the peeling ability may be insufficient from fixing devices, or electrophotographic image-receiving sheets may adhere each other to cause blocking under their preservation at high temperatures; in addition, the electrophotographic image-receiving sheets tend to adhere with production lines to induce process problems; in addition, the electrophotographic image-receiving sheets tend to lose the transportability and cause jamming in image forming apparatuses. On the other hand, in cases where the melting point is above 110° C., the toner fixability may be low, the glossiness may be insufficient, the image quality may be deteriorated due to edge voids, and/or images may crack upon folding; in addition, it may be difficult to produce the stable aqueous dispersion.

The melting point may be determined by measurement devices such as differential scanning calorimeters (DSC).

The heat of crystal fusion of the crystalline polyester resin is preferably 60 J/g or more, more preferably 80 J/g or more. In cases where the heat of crystal fusion is below 60 J/g, the electrophotographic image-receiving sheets may cause blocking and/or generate jamming due to lower transportability in image forming apparatuses.

The heat of crystal fusion may be determined by measurement devices such as differential scanning calorimeters (DSC).

The crystallization temperature in the cooling stage of the crystalline polyester resin is preferably 30° C. or more, more preferably 50° C. or more. In cases where the crystallization temperature in the cooling stage is below 30° C., the peeling ability may be insufficient from fixing devices, or the glossiness may be poor at white backgrounds.

The crystallization temperature in the cooling stage may be determined by measurement devices such as differential scanning calorimeters (DSC).

It is preferred that the acid value of the crystalline polyester resin is 20 to 40 mgKOH/g, more preferably 22 to 32 mgKOH/g. In cases where the acid value is below 20 mgKOH/g, the aqueous dispersion may be unstable, and when the acid value is above 40 mgKOH/g, the toner image-receiving layer may exhibit poor strength and represent poor water/moisture resistance. The acid value may be determined in accordance with JIS K 0070, for example.

It is preferred that the crystalline polyester resin has a number average molecular mass of 5000 or more, more preferably 8000 or more. In cases where the number average molecular mass is below 5000, the toner image-receiving layer may represent lower mechanical strength, which possibly leading to cracking and/or peeling of the toner image-receiving layer.

The number average molecular mass may be determined by gel permeation chromatography (GPC), for example.

The aqueous dispersion of the crystalline polymer contains at least the crystalline polymer, a basic compound, water, and also other optional ingredients. The aqueous dispersion of the crystalline polymer may be prepared by conventional processes, for example, comprising a step of forming a solution of the polyester resin in an amphiphilic organic solvent, a step of forming an emulsion by mixing the solution, the basic compound, and water, and a step of removing the organic solvent from the emulsion.

The solid content of the crystalline polymer is preferably 1 to 40% by mass in the aqueous dispersion of the crystalline polymer.

The basic compound is added in order to disperse stably and uniformly the crystalline polymer into water. Examples of the basic compounds include ammonia, methylamine, dimethylamine, trimethylamine, ethylamine, diethylamine, triethylamine, propylamine, dipropylamine, isopropylamine, diisopropylamine, butylamine, dibutylamine, isobutylamine, diisobutylamine, sec-butylamine, tert-butylamine, pentylamine, N,N-dimethylethanolamine, N-methyl-N-ethanolamine, propylene diamine, morpholine, N-methylmorpholine, N-ethylmorpholine and piperidine. These may be used alone or in combination.

It is preferred that the amount of the basic compound is 0.9 to 15 times of the amount of the carboxylic group in the crystalline polyester resin, i.e. corresponding amount capable of at least partially neutralize the carboxylic group, more preferably 1 to 5 times. When the amount is below 0.9 times, the aqueous dispersion may be unstable due to difficult dispersion thereof, and when the amount is above 15 times, the aqueous dispersion may be excessively viscous.

It is also preferred that the toner image-receiving layer is formed from a coating liquid for toner image-receiving layer that contains at least the aqueous dispersion of the crystalline polymer and a phase-separated structure. The term "phase separated structure" refers to a condition where polymers with different structures and/or other organic additives are non-phase soluble and separable microscopically.

The existence of the phase-separated structure in the toner image-receiving layer may be determined by way of observing the toner image-receiving layer whether or not an endothermic peak appears on the basis of crystal fusion using a differential scanning calorimeter (DSC). The phase separated structure formed from the aqueous dispersion of the crystalline polymer may also be determined by observing grain boundaries between approximately circular non-aqueous phase structure of the crystalline polymer and the other phase structure at a cross section of the toner image-receiving layer by use of a scanning electron microscope or a transmission electron microscope.

Amorphous Polymer

It is preferred in the present invention that an amorphous polymer is used in addition to the crystalline polymer. The combination of the crystalline polymer and the amorphous polymer is more preferable since the glossiness may be improved at white backgrounds without degrading the adhesion resistance.

The amorphous polymer may be properly selected depending on the application, preferably, the polymer is thermoplastic resins in view of productivity etc.; examples thereof include amorphous polyester resins, polyvinylchloride resins, polystyrene resins, acrylonitrile-styrene copolymers, acrylonitrile-butadiene-styrene copolymers, polymethylmethacrylate resins, polycarbonate resins, modified phenylene ether resins, polyacrylate resins, polysulfone resins, polyether imide resins, polyamide imide resins, polyimide resins and copolymers of these two or more. These may be used alone or in combination. Among these, amorphous polyester resins are particularly preferable in view of wide freedom in selecting structure, moderate heat adhesiveness, and blocking resistance.

The amorphous polyester resin may be those prepared through condensation polymerization between polybasic acids and polyvalent alcohols, which may be conventional ones without limitation.

Examples of the polybasic acid include oxalic acid, succinic anhydride, adipic acid, azelaic acid, sebacic acid, dodecanedioic acid, arachidionic acid, hydrogenated dimer acid, fumaric acid, maleic acid, maleic anhydride, malonic acid, n-dodecenylsuccinic acid, isododecenylsuccinic acid, n-dodecylsuccinic acid, isododecylsuccinic acid, n-octenylsuccinic acid, isooctenylsuccinic acid, n-octylsuccinic acid, isooctylsuccinic acid, itaconic acid, itaconic anhydride, citraconic acid, citraconic anhydride, dimer acid, terephthalic acid, isophthalic acid, orthophthalic acid, naphthalenedicarboxylic acid, biphenyldicarboxylic acid, 1,4-cyclohexanedicarboxylic acid, 1,3-cyclohexanedicarboxylic acid, 1,2-cyclohexanedicarboxylic acid, 2,5-norbornenedicarboxylic acid, 2,5-norbornenedicarboxylic anhydride, tetrahydrophthalic acid, tetrahydrophthalic anhydride and lower alkylesters of these acids.

Examples of the polyvalent alcohol include ethylene glycol, 1,2-propylene glycol, 1,3-propanediol, 1,4-butanediol, 2-methyl-1,3-propanediol, 1,5-pentanediol, neopentyl glycol, 1,6-hexanediol, 3-methyl-1,5-pentanediol, 1,9-nonanediol, 2-ethyl-2-propanediol, 1,4-cyclohexanedimethanol, diethylene glycol, triethylene glycol, and dipropylene glycol, and also glycols that are prepared by adding from one to several moles of ethylene oxide or propylene oxide to two phenolic hydroxide groups of bisphenols e.g. 2,2-bis(4-hydroxyethoxyphenyl)propane. Polyethylene glycol, polypropylene glycol, and polytetramethylene glycol may also be used as required.

It is particularly preferable among these that the amorphous polyester resin is prepared from the polybasic acid of at least one of terephthalic acid, isophthalic acid and adipic acid and the polyvalent alcohol of at least one of ethylene glycol, neopentyl glycol and 2,2-bis(4-hydroxyethoxyphenyl)propane.

The glass transition temperature of the amorphous polymer may be properly selected depending on the application; preferably, the glass transition temperature is 30° C. to 120° C., more preferably 50° C. to 100° C. In cases where the glass transition temperature of the amorphous polymer is below 30° C., the electrophotographic image-receiving sheets may adhere with each other to cause blocking under their preservation at high temperatures and/or generate jamming due to lower transportability in image forming apparatuses. In cases where the glass transition temperature of the amorphous polymer is above 120° C., the toner fixability may be low, the glossiness may be insufficient, the image quality may be deteriorated due to edge voids, and/or images may crack easily at folding.

The glass transition temperature of the amorphous polymer and the melting point of the crystalline polymer may be determined from an endothermic peak on the basis of crystal fusion by way that the polymer is heated from room temperature to 320° C. in nitrogen atmosphere and is allowed to stand under the condition for 10 minutes; then the polymer is rapidly cooled to about room temperature, immediately followed by heating from room temperature to 320° C. at a rate of 5° C./min by use of a differential scanning calorimeter (DSC).

The molecular mass of the amorphous polymer may be properly selected depending on the application; preferably, the number average molecular mass is 3000 to 20,000. In cases where the number average molecular mass of the amorphous polymer is below 3000, the film properties of the toner image-receiving layer may degrade, cracks tend to generate in the image-receiving layer and/or the adhesion resistance may be poor. On the other hand, in cases where the number average molecular mass amorphous polymer is above 20,000, the toner image-receiving layer may lose the sharp-melting property, and it may be difficult to balance well the low temperature fixability and the adhesion resistance.

The content of the mixture of the amorphous polymer and the crystalline polymer is preferably 50% by mass or more, more preferably 70% by mass or more as the solid content in the total weight of the composition for the toner image-receiving layer.

The mass ratio in the mixture of the amorphous polymer and the crystalline polymer is preferably 50:50 to 95:5, more preferably 75:25 to 90:10 (amorphous polymer:crystalline polymer). In cases where the mass ratio of the amorphous polymer is low, the peeling property may be insufficient from the fixing devices, the glossiness may be poor at the white background, and/or the surface may be brittle or rough. On the other hand, in cases where the mass ratio of the amorphous polymer is low, the adhesion resistance may be insufficient, the fixability may be unsatisfactory and/or the transportability may be deteriorated.

In addition to the resin ingredients, the coating liquid for toner image-receiving layer may contain other optional ingredients such as releasing agents, lubricants, colorants, fillers, crosslinking agents, charge control agents, emulsifiers, dispersants, etc.

Releasing Agent

The releasing agent may be incorporated into the toner image-receiving layer to prevent offset of the toner image-receiving layer. The releasing agent may be properly selected depending on the application as long as capable of forming a releasing-agent layer on the toner image-receiving layer through being heated and melted at the fixing temperature then depositing and locally existing through being cooled and solidified.

The releasing agents are exemplified by silicone compounds, fluorine compounds, waxes and matting agents.

The releasing agent may be, for example, those described in "Properties and Applications of Waxes-Revised edition" published by Saiwai Shobo and "Handbook of Silicones" issued by Nikkan Kogyo Shimbun, Ltd. The silicone compounds, fluorine compounds and waxes are also available that are described in Japanese Patent (JP-B) Nos. 2838498, and 2949585, and Japanese Patent Application Laid Open (JP-A) Nos. 59-38581, 04-32380, 50-117433, 52-52640, 5757-148755, 61-62056, 61-62057, 61-118760, 02-42451, 03-41465, 04-212175, 04-214570, 04-263267, 05-34966, 05-119514, 06-59502, 06-161150, 06-175396, 06-219040, 06-230600, 06-295093, 07-36210, 07-36210, 07-43940, 07-56387, 07-56390, 07-64335, 07-199681, 07-223362, 07-223362, 07-287413, 08-184992, 08-227180, 08-248671, 08-248799, 08-248801, 08-278663, 09-152739, 09-160278, 09-185181, 09-319139, 09-319143, 10-20549, 10-48889, 10-198069, 10-207116, 11-2917, 11-44969, 11-65156, 11-73049, and 11-194542. These may be used alone or in combination.

Examples of the silicone compounds include silicone oils, silicone rubbers, silicone fine particles, silicone-modified resins and reactive silicone compounds.

Examples of the silicone oils include unmodified silicone oil, amino-modified silicone oils, carboxy-modified silicone oils, carbinol-modified silicone oils, vinyl-modified silicone oils, epoxy-modified silicone oils, polyether-modified silicone oils, silanol-modified silicone oils, methacryl-modified silicone oils, mercapto-modified silicone oils, alcohol-modified silicone oils, alkyl-modified silicone oils, and fluorine-modified silicone oils.

Examples of the silicone-modified resins include olefin resins, polyester resins, vinyl resins, polyamide resins, cellulose resins, phenoxy resins, vinylchloride-vinylacetate resins, urethane resins, acrylic resins, styrene-acryl resins, and copolymer resins thereof modified with silicone.

The fluorine compound may be properly selected depending on the application; examples thereof include fluorine oils, fluorine rubbers, fluorine-modified resins, fluorine sulfonate compounds, fluorosulfonate, fluorine acid compounds or salts thereof, and inorganic fluorides.

The waxes may be classified generally into natural waxes and synthetic waxes. The natural waxes are preferably one selected from vegetable, animal, mineral, and petroleum waxes; among these, vegetable waxes are particularly preferable. The natural waxes are preferably water-dispersible waxes in terms of compatibility in cases where aqueous resins are used for the toner image-receiving layer.

The vegetable waxes may be properly selected from conventional ones that are commercially available or synthesized. Examples of the vegetable wax include carnauba waxes, castor oils, rapeseed oils, soybean oils, vegetable tallow, cotton waxes, rice waxes, sugarcane waxes, candelilla waxes, Japan waxes and jojoba waxes. The commercially available carnauba waxes are exemplified by EMUSTAR-0413 (Nippon Seiro Co.) and Cellozol 524 (Chukyo Yushi Co.). The commercially available castor oils are exemplified by purified castor oils (Itoh Oil Chemicals Co.).

Among these, carnauba waxes having a melting point of 70° C. to 95° C. are particularly preferable in view of electrophotographic image-receiving sheets that are superior in offset resistance, adhesion resistance, paper transportability, glossiness and cracking resistance.

The animal waxes may be properly selected from conventional ones; examples thereof include bee waxes, lanolin, whale waxes, whale oils and sheep wool waxes.

The mineral waxes may be properly selected from conventional ones that may be commercially available or synthesized. Examples thereof include montan wax, montan-ester wax, ozokerite and ceresin.

Among these, montan waxes having a melting point of 70° C. to 95° C. are particularly preferable in view of electrophotographic image-receiving sheets that are superior in offset resistance, adhesion resistance, paper transportability, glossiness and cracking resistance.

The petroleum waxes may be properly selected from conventional ones that may be commercially available or synthesized; examples thereof include paraffin waxes, microcrystalline waxes and petrolatum.

The content of the natural wax in the toner image-receiving layer is preferably 0.1 to 4 $g/m^2$, more preferably 0.2 to 2 $g/m^2$.

When the content of the natural wax is less than 0.1 $g/m^2$, the offset resistance may be insufficient, and when the content is more than 4 $g/m^2$, the image quality may be degraded due to the excessive wax.

The melting point of the natural wax is preferably 70° C. to 95° C., and more preferably 75° C. to 90° C. from the viewpoint of the offset resistance and paper transportability.

The synthetic waxes may be classified into synthetic hydrocarbons, modified waxes, hydrogenated waxes, and other fat and fatty oil synthetic waxes. These waxes are preferably water-dispersible waxes in terms of compatibility in cases where aqueous thermoplastic resins are used for the toner image-receiving layer.

Examples of the synthetic hydrocarbon waxes include Fischer-Tropsch waxes and polyethylene waxes. Examples of the fat and fatty oil synthetic waxes include acid amide compounds such as stearic acid amid and acid imide compounds such as phthalic anhydride imide.

The modified waxes may be properly selected depending on the application; examples thereof include amine-modified waxes, acrylic acid-modified waxes, fluorine-modified waxes, olefin-modified waxes, urethane waxes and alcohol waxes.

Examples of the hydrogenated waxes may be properly selected depending on the application; examples thereof include hardened castor oils, castor oil derivatives, stearic acids, lauric aids, myristic acids, palmitic acids, behenyl acids, sebacic acids, undecylenic acids, heptyl acids, maleic acids and highly maleated oils.

The matting agent may be properly selected from various conventional ones. The solid particles for the matting agent may be classified into inorganic particles and organic particles. Examples of the inorganic matting agents include oxides such as silicon dioxide, titanium oxide, magnesium oxide, and aluminum oxide; alkaline earth metal salts such as barium sulfate, calcium carbonate, and magnesium sulfate; silver halides such as silver chloride and silver bromide; and glasses.

Specific examples of the inorganic matting agents are disclosed in West German Patent No. 2529321, U.K. Patent Nos. 760775 and 1260772, and U.S. Pat. Nos. 1,201,905, 2,192,241, 3,053,662, 3,062,649, 3,257,206, 3,322,555, 3,353,958, 3,370,951, 3,411,907, 3,437,484, 3,523,022, 3,615,554, 3,635,714, 3,769,020, 4,021,245 and 4,029,504.

Examples of the organic matting agents include starches, cellulose esters such as cellulose acetate propionate, cellulose ethers such as ethyl cellulose and synthetic resins. The synthetic resins are preferably water-insoluble or low-water soluble. Examples of the synthetic water-insoluble or low-water soluble resins include poly(meth)acrylic acid esters such as polyalkyl(meth)acrylate, polyalkoxyalkyl(meth) acrylate and polyglycidyl(meth)acrylate; poly(meth)acrylamide, polyvinyl esters such as polyvinyl acetate; polyacrylonitrile, polyolefins such as polyethylene; polystyrene resin, benzoguanamine resins, formaldehyde condensation polymer, epoxy resins, polyamide resins, polycarbonate resins, phenolic resins, polyvinyl carbazole resins and polyvinylidene chloride resins. The copolymers in combination of these monomers may be available.

The copolymers may contain a small amount of hydrophilic repeating units. The monomers of the hydrophilic repeating units are exemplified by acrylic acid, methacrylic acid, α,β-unsaturated dicarboxylic acid, hydroxyalkyl(meth) acrylate, sulfoalkyl(meth)acrylate and styrene sulfonic acid.

Specific examples of the organic matting agents are disclosed in U.K. Patent No. 1055713, U.S. Pat. Nos. 1,939,213, 2,221,873, 2,268,662, 2,322,037, 2,376,005, 2,391,181, 2,701,245, 2,992,101, 3,079,257, 3,262,782, 3,443,946, 3,516,832, 3,539,344, 3,591,379, 3,754,924 and 3,767,448, and JP-A Nos. 49-106821 and 57-14835.

The matting agent may be two or more species of solid particles. The average particle diameter of the solid particles is preferably 1 to 100 μm, more preferably 4 to 30 μm. The amount of the solid particles is preferably 0.01 to 0.5 g/m$^2$, more preferably 0.02 to 0.3 g/m$^2$.

The melting point of the releasing agent is preferably 70° C. to 95° C., and more preferably 75° C. to 90° C. from the viewpoint of the offset resistance and paper transportability.

The releasing agent in the toner image-receiving layer may also be derivatives, oxides, purified materials, or mixtures of the substances described above, and may have a reactive substituent.

The content of the releasing agent is preferably 0.1 to 10% by mass based on the mass of the toner image-receiving layer, more preferably 0.3 to 8.0% by mass, still more preferably 0.5 to 5.0% by mass.

When the content of the natural wax is less than 0.1% by mass, the offset resistance and adhesion resistance may be insufficient, and when the content is more than 10% by mass, the image quality may be degraded due to the excessive amount.

Plasticizer

The plasticizer may be properly selected from those used conventionally for resins depending on the application. The plasticizer performs to control flowability and/or softening of the toner image-receiving layer by means of heat and/or pressure at fixing the toner.

Examples of the plasticizer are described in "Kagaku Binran (Chemical Handbook)" (edited by The Chemical Society of Japan, published by Maruzen Co.), "Plasticizer, Theory and Application" (edited by Koichi Murai, published by Saiwai Shobo), "Volumes 1 and 2 of Studies on Plasticizer" (edited by Polymer Chemistry Association), and "Handbook on Compounding Ingredients for Rubbers and Plastics" (edited by Rubber Digest Co.).

Some plasticizers are described as an organic solvent having a high boiling point or a thermal solvent in some literatures. Examples of the plasticizer include esters such as phthalate esters, phosphorate esters, fatty esters, abietate esters, adipate esters, sebacate esters, azelate esters, benzoate esters, butyrate esters, epoxidized fatty esters, glycolate esters, propionate esters, trimellitate esters, citrate esters, sulfonate esters, carboxylate esters, succinate esters, malate esters, fumarate esters, phthalate esters and stearate esters; amides such as fatty amides and sulfonate amides; ethers, alcohols, lactones and polyethylene oxides, which are described in JP-A Nos. 59-83154, 59-178451, 59-178453, 59-178454, 59-178455, 59-178457, 62-174754, 62-245253, 61-209444, 61-200538, 62-8145, 62-9348, 62-30247, 62-136646 and 02-235694 etc. These plasticizers may be incorporated into the resins.

The plasticizer may be polymers of lower molecular masses. It is preferred that the molecular mass of the plasticizer is less than that of the binder resin to be plasticized; preferably, the molecular mass is 15000 or less, more preferably 5000 or less. In cases where the plasticizer is a polymer, the polymer is preferably the same type as that of the binder resin to be plasticized. For example, it is preferred that a polyester of lower molecular masses is employed for plasticizing a polyester resin. Oligomers may also be employed for the plasticizer.

In addition, commercially available ones may be employed such as Adekacizer PN-170 and PN-1430 (by Asahi Denka Kogyo Co.); PARAPLEX G-25, G-30 and G-40 (by C. P. Hall Co.); and Ester Gum 8L-JA, Ester R-95, Pentalin 4851, FK 115, 4820, 830, Luisol 28-JA, Picolastic A75, Picotex LC and Crystalex 3085 (by Rika Hercules Co.).

The plasticizer may be optionally used for relaxing the stress and strain, i.e. physical strain such as elastic force and viscosity or strain due to material balance in molecules or main chain and pendant moiety of binder when toner particles being embedded in the toner image-receiving layer.

The plasticizer may be finely and microscopically dispersed, phase-separated like a sea-island structure, or mixed and dissolved with other components such as binder resins, in the toner image-receiving layer.

The content of the plasticizer in the toner image-receiving layer is preferably 0.001% by mass to 90% by mass, more preferably 0.1% by mass to 60% by mass, still more preferably 1% by mass to 40% by mass, based on the mass of the toner image-receiving layer.

The plasticizer may be used for controlling slip properties to improve the transportability by reducing the friction, improving the offset at fixing parts to peel the toner or the layer, controlling the curling balance, or adjusting the electrostatic charge to form toner electrostatic images.

Colorant

The colorant may be properly selected depending on the application; examples thereof include fluorescent whitening agents, white pigments, color pigments, and dyes.

The fluorescent whitening agent may be appropriately selected from conventional ones that have an absorption in near-ultraviolet region and emit a fluorescence of 400 nm to 500 nm; preferable examples are described in "The Chemistry of Synthetic Dyes, Volume V" (by K. Veen Rataraman, Chapter 8). The fluorescent whitening agent may be commercially available or suitably synthesized; examples thereof include stilbene, coumarin, biphenyl, benzoxazoline, naphthalimide, pyrazoline, and carbostyril compounds. Examples of the commercially available ones include white furfar-PSN, PHR, HCS, PCS and B (by Sumitomo Chemicals Co.) and UVITEX-OB (by Ciba-Geigy Co.).

The white pigment may be properly selected from conventional ones depending on the application; examples thereof include inorganic pigments such as titanium oxide and calcium carbonate.

The color pigment may be properly selected from conventional ones; examples thereof include various pigments described in JP-A No. 63-44653, azo pigments, polycyclic pigments, condensed polycyclic pigments, lake pigments, and carbon black.

Examples of the azo pigment include azo lake pigments such as carmine 6B and red 2B; insoluble azo pigments such as monoazo yellow, disazo yellow, pyrazolone orange and Vulcan orange; condensed azo pigments such as chromophthal yellow and chromophthal red. Examples of the polycyclic pigment include phthalocyanine pigments such as copper phthalocyanine blue and copper phthalocyanine green. Examples of the condensed polycyclic pigment include dioxazine pigments such as dioxazine violet, isoindolinone pigments such as isoindolinone yellow, threne pigments, perylene pigments, perinone pigments and thioindigo pigments.

Examples of the lake pigment include malachite green, rhodamine B, rhodamine G and Victoria blue B. Examples of the inorganic pigment include an oxides such as titanium dioxide and iron oxide red; sulfate salts such as precipitated barium sulfate; carbonate salts such as precipitated calcium carbonate; silicate salts such as hydrous silicate salts and anhydrous silicate salts; metal powders such as aluminum powder, bronze powder, zinc powder, chrome yellow and iron blue. These may be used alone or in combination.

The dyes may be properly selected from conventional ones depending on the application; examples thereof include anthraquinone compounds and azo compounds. These dyes may be used alone or in combination.

The water-insoluble dyes are exemplified by vat dyes, disperse dyes, and oil-soluble dyes. Specific examples of the vat dye include C. I. Vat violet 1, C. I. Vat violet 2, C. I. Vat violet 9, C. I. Vat violet 13, C. I. Vat violet 21, C. I. Vat blue 1, C. I. Vat blue 3, C. I. Vat blue 4, C. I. Vat blue 6, C. I. Vat blue 14, C. I. Vat blue 20 and C. I. Vat blue 35. Specific examples of the disperse dye include C. I. disperse violet 1, C. I. disperse violet 4, C. I. disperse violet 10, C. I. disperse blue 3, C. I. disperse blue 7, and C. I. disperse blue 58. Specific examples of the oil-soluble dye include C. I. solvent violet 13, C. I. solvent violet 14, C. I. solvent violet 21, C. I. solvent violet 27, C. I. solvent blue 11, C. I. solvent blue 12, C. I. solvent blue 25 and C. I. solvent blue 55.

Colored couplers used in silver halide photography may also be used as the dye.

The content of the colorant in the toner image-receiving layer is preferably 0.1 to 8 g/m$^2$, and more preferably 0.5 to 5 g/m$^2$.

The colorant content of less than 0.1 g/m$^2$ may lead to excessively high light transmittance at the toner image-receiving layer, and the amount of more than 8 g/m$^2$ may be undesirable for handling, crazing and/or adhesion resistance.

The amount of the pigment is preferably 40% by mass or less, more preferably 30% by mass or less, and still more preferably 20% by mass or less based on the mass of the thermoplastic resin in the toner image-receiving layer.

Filler

The filler may be organic or inorganic ones that are conventionally used as reinforcing agents, fillers, or reinforcing agents for binder resins. The filler may be properly selected by referring to "Handbook of Rubber and Plastics Additives" (edited by Rubber Digest Co.), "Plastics Blending Agents—Basics and Applications" (New Edition) (published by Taisei Co.), or "The Filler Handbook" (published by Taisei Co.).

The filler may be conventional inorganic fillers or pigments; specific examples thereof include silica, alumina, titanium dioxide, zinc oxide, zirconium oxide, micaceous iron oxide, white lead, lead oxide, cobalt oxide, strontium chromate, molybdenum pigments, smectite, magnesium oxide, calcium oxide, calcium carbonate and mullite. Among these, silica and alumina are preferable. These may be used alone or in combination. It is preferred that the filler has small particle diameters, since Higher particle diameters tend to roughen the surface of toner image-receiving layers.

The silica described above may be spherical or amorphous. The silica may be produced by dry, wet, or aero-gel processes. Hydrophobic silica particles may be surface-treated with trimethylsilyl group or silicones as required. The silica is preferably colloidal silica and/or porous.

The alumina described above may be anhydrous or hydrated one. Examples of the crystallized anhydrous alumina include $\alpha$, $\beta$, $\gamma$, $\delta$, $\zeta$, $\eta$, $\theta$, $\kappa$, $\rho$, or $\chi$; hydrated alumina is more preferable than anhydrous alumina. Examples of the hydrated alumina include monohydrated alumina and trihydrate alumina. Examples of the monohydrated alumina include pseudo-boehmite, boehmite and disport. Examples of the trihydrated alumina include gibbsite and bayerite. The alumina is preferably porous.

The hydrated alumina may be synthesized by sol-gel processes in which ammonia is added to an aluminum-salt solution to precipitate alumina or by hydrolyzing an alkali aluminate. The anhydrous alumina may be produced by heating to dehydrate the hydrated alumina.

The content of the filler is preferably 5 to 2000 parts by mass based on 100 parts by dry mass of the binder resin in the toner image-receiving layer.

Crosslinking Agent

The crosslinking agent may be incorporated in the resin composition of the toner image-receiving layer for controlling the shelf stability and thermoplasticity of the toner image-receiving layer. The crosslinking agent are exemplified by compounds having in the molecule two or more reactive groups selected from the group consisting of epoxy group, isocyanate group, aldehyde group, active halogen group, active methylene group, acetylene group and other conventional reactive groups.

The crosslinking agent may also exemplified by compounds having in the molecule two or more groups which can form a bond through a hydrogen bond, an ionic bond or a coordination bond.

Specific examples of the crosslinking agent include conventional compounds as coupling agents, curing agents, polymerizing agents, polymerization promoters, coagulants, film-forming agents, or film-forming assistants used for conventional resins. Examples of the coupling agent include chlorosilanes, vinylsilanes, epoxisilanes, aminosilanes, alkoxy aluminum chelates, titanate coupling agents, and other conventional crosslinking agents described in the literature "Handbook of Rubber and Plastics Additives" (edited by Rubber Digest Co.).

Charge Control Agent

The toner image-receiving layer preferably contains a charge control agent for controlling the transfer and adhesion of the toner and for preventing the adhesion of the toner image-receiving layer due to the charge.

The charge control agent may be properly selected from various conventional ones depending on the application; examples thereof include surfactants such as cationic surfactants, anionic surfactants, amphoteric surfactants, and non-ionic surfactants; polymer electrolytes, and conductive metal oxides. Specific examples of the charge control agent include cationic antistatic agents such as quaternary ammonium salts, polyamine derivatives, cation-modified polymethyl methacrylate, cation-modified polystyrenes; anionic antistatic agents such as alkyl phosphates and anionic polymers; and non-ionic antistatic agents such as fatty esters, and polyethylene oxides.

When the toner is negatively charged, the charge control agent in the toner image-receiving layer is preferably a cationic or nonionic charge control agent.

Examples of the conductive metal oxide include ZnO, $TiO_2$, $SnO_2$, $Al_2O_3$, $In_2O_3$, $SiO_2$, MgO, BaO and $MoO_3$. These may be used alone or in combination. The conductive metal oxide may contain or dope another different element, for example, ZnO may contain or dope Al and In; $TiO_2$ may contain Nb and Ta; and $SnO_2$ may contain Sb, Nb and halogen elements.

Other Additives

The toner image-receiving layer may also contain various additives for improving the stability of the output image or the stability of the toner image-receiving layer itself. Examples of the additives include various conventional antioxidants, anti-aging agents, deterioration inhibitors, ozone-deterioration inhibitors, ultraviolet ray absorbers, metal complexes, light stabilizers, antiseptic agents and anti-fungus agents.

The antioxidant may be properly selected depending on the application; examples thereof include chroman compounds, coumarin compounds, phenol compounds such as hindered phenol, hydroquinone derivatives, hindered amine derivatives, and spiroindane compounds. The antioxidant is also disclosed in JP-A No. 61-159644.

The anti-aging agent may be properly selected depending on the application; examples thereof include those described in "Handbook of Rubber and Plastics Additives—Revised Second Edition" (published by Rubber Digest Co., 1993, pp. 76-121).

The ultraviolet ray absorber may be properly selected depending on the application; examples thereof include benzotriazol compounds (see U.S. Pat. No. 3,533,794), 4-thiazolidone compounds (see U.S. Pat. No. 3,352,681), benzophenone compounds (see JP-A No. 46-2784), and ultraviolet ray absorbing polymers (see JP-A No. 62-260152).

The metal complex may be properly selected depending on the application; proper examples thereof are described in U.S. Pat. Nos. 4,241,155, 4,245,018, and 4,254,195; and JP-A Nos. 61-88256, 62-174741, 63-199248, 01-75568 and 01-74272.

In addition, ultraviolet ray absorbers or light stabilizers may be those described in "Handbook on Compounding Ingredients for Rubbers and Plastics, revised second edition" (published by Rubber Digest Co., 1993, pp. 122-137).

The toner image-receiving layer may optionally contain the above-noted conventional photographic additives. Examples of the photographic additives include those described in "Journal of Research Disclosure (hereinafter referred to as RD) No. 17643 (December, 1978), No. 18716 (November, 1979) and No. 307105 (November, 1989)"; the related portions are shown in the Table 1 below.

TABLE 1

| Additive | RD17643 | RD18716 | RD307105 |
|---|---|---|---|
| Whitening agent | p.24 | p.648 right column | p.868 |
| Stabilizer | pp.24-25 | p.649 right column | pp.868-870 |
| Light (UV) absorber | pp.25-26 | p.649 right column | p.873 |
| Dye image stabilizer | p.25 | p.650 right column | p.872 |
| Film hardener | p.26 | p.651 left column | pp.874-875 |
| Binder | p.26 | p.651 left column | pp.873-874 |
| Plasticizer, lubricant | p.27 | p.650 right column | p.876 |
| Auxiliary coating agent | pp.26-27 | p.650 right column | pp.875-876 |
| Antistatic agent | p.27 | p.650 right column | pp.876-877 |
| Matting agent | — | — | pp.878-879 |

The toner image-receiving layer is disposed on the support by coating the support with the coating solution containing a thermoplastic resin used for producing the toner image-receiving layer using a wire coater and by drying the resultant coating.

The mass of the dried coating as the toner image-receiving layer is preferably from 1 $g/m^2$ to 20 $g/m^2$, more preferably from 4 $g/m^2$ to 15 $g/m^2$. The thickness of the toner image-receiving layer may be properly selected depending on the application; preferably, the thickness is 1 μm to 50 μm, more preferably 1 μm to 30 μm, still more preferably 2 μm to 20 μm, most preferably from 5 μm to 15 μm.

Properties of Toner Image-Receiving Layer

The 180 degree peel strength of the toner image-receiving layer, at the fixing temperature with a fixing member, is preferably 0.1 N/25 mm or less, more preferably 0.041 N/25 mm or less. The 180 degree peel strength can be measured in accordance with JIS K 6887 using the surface material of the fixing member.

It is preferred that the toner image-receiving layer has a high glossiness after image formation. The 45° glossiness of the toner image-receiving layer is preferably 60 or more, more preferably 75 or more, still more preferably 90 or more over the entire region from white with no toner to black with the highest toner concentration. The glossiness of the toner image-receiving layer is preferably 110 or less, since the glossiness above 110 may resemble a metal gloss unfavorable for image quality. The gloss level can be measured according to JIS Z 8741.

It is preferred that the toner image-receiving layer has a high smoothness after image formation. The smoothness of the toner image-receiving layer is preferably 3 μm or less, more preferably 1 μm or less, still more preferably 0.5 μm or less with respect to arithmetic average surface roughness Ra over the entire region from white with no toner to black with the highest toner concentration.

The arithmetic average surface roughness may be measured according to JIS B 0601, JIS B 0651 and JIS B 0652.

The toner image-receiving layer has preferably at least one of the physical properties described in the following items (1) to (6), more preferably several of them, most preferably all of them.

(1) It is preferred that the melting temperature (Tm) of the toner image-receiving layer is 30° C. or higher and no higher than Tm +20° C.

(2) It is preferred that the temperature, at which the viscosity of the toner image-receiving layer being $1\times10^5$ cp, is 40° C. or higher and lower than that of the toner.

(3) It is preferred that the storage elasticity modulus (G') of the toner image-receiving layer is from $1\times10^2$ Pa to $1\times10^5$ Pa and the loss elasticity modulus (G") is preferably from $1\times10^2$ Pa to $1\times10^5$ Pa at the fixing temperature.

(4) It is preferred that the loss tangent (G"/G') of the toner image-receiving layer at the fixing temperature is from 0.01 to 10, wherein the loss tangent is the ratio of the loss elasticity modulus (G") to the storage elasticity modulus (G').

(5) It is preferred that the storage elasticity modulus (G') of the toner image-receiving layer at the fixing temperature differs by −50 to +2500 from the storage elasticity modulus (G') of the toner at the fixing temperature.

(6) The inclination angle of the molten toner on the toner image-receiving layer is preferably 50° or less, more preferably 40° or less.

The toner image-receiving layer preferably satisfies the physical properties described in Japanese Patent No. 2788358 and JP-A Nos. 07-248637, 08-305067 and 10-239889.

The surface electrical resistance of the toner image-receiving layer is preferably in the range of from $1\times10^6$ Ω/cm$^2$ to $1\times10^{15}$ Ω/cm$^2$ (under conditions of 25° C. and 65% RH).

When the surface electrical resistance is less than $1\times10^6$ Ω/cm$^2$, the amount of the toner transferred to the toner image-receiving layer is insufficient such that the density of the toner images is unfavorably low, and when the surface electrical resistance is more than $1\times10^{15}$ Ω/cm$^2$, unnecessary charge tends to generate in the toner image-receiving layer during the transfer, thus the toner is insufficiently transferred, the image density is low, electrophotographic image-receiving sheets tend to be electrostatically charged to adsorb easily the ambient dusts. Moreover, miss feed, overlapping feed, discharge marks, and toner-transfer voids may occur during the copying processes.

The surface electrical resistance can be measured according to JIS K 6911 as follows: the sample of the toner image-receiving layer is conditioned under temperature 20° C. and humidity 65% for 8 hours or more, and after applying a voltage of 100 V to the sample of the toner image-receiving layer for 1 minute under the same condition as the above-noted condition using a micro-ammeter R8340 (by Advantest Ltd.).

Support

Examples of the support are raw paper, synthetic paper, synthetic resin sheet, coated paper, and laminated paper. The support may be of single-layer or laminated structure of two or more layers. Among these, laminated paper coated with polyolefin resin layers on one or both sides of raw paper is preferable in view of flat glossiness and flexibility.

Raw Paper

The raw paper may be properly selected depending on the application; specific examples thereof include the book papers described in the literature "Basis of Photographic Technology-silver halide photograph (edited by The Society of Photographic Science and Technology of Japan and published by Corona Publishing Co., Ltd. (1979) (pp. 223-224)".

For smoothing the surface of the raw paper, it is preferred that the raw paper is produced, as described in JP-A No. 58-68037, using a pulp fiber having a fiber length distribution in which a total of a 24 mesh screen remnant and a 42 mesh screen remnant is from 20% by mass to 45% by mass and a 24 mesh screen remnant is 5% by mass or less, based on the mass of all pulp fibers. Moreover, the mean center line roughness of the raw paper can be controlled by subjecting the raw paper to a surface treatment by applying the heat and pressure using a machine calendar or a super calendar.

The raw paper may be properly selected from conventional materials in the art; examples thereof include natural pulp such as of conifer and broadleaf trees, and mixtures of natural pulp and synthetic pulp.

The pulp of the raw paper is preferably broadleaf tree kraft pulp (LBKP), bleached conifer kraft pulp (NBKP) or broadleaf tree sulfite pulp (LBSP), in view of the surface smoothness, rigidity and dimension stability (curl property) of the raw paper. Beaters or refiners may be used for beating the pulp.

The Canada Standard Filtered Water Degree of the pulp is preferably 200 ml to 440 ml C.S.F., and more preferably 250 ml to 380 ml C.S.F. because the shrinkage of the paper can be controlled in paper making.

Various additives, for example, fillers, dry paper reinforcers, sizing agents, wet paper reinforcers, fixing agents, pH regulators or other agents, or the like may be added, if necessary, to the pulp slurry (hereafter referred to as "pulp paper material") which is obtained after beating the pulp.

Examples of the fillers include calcium carbonate, clay, kaolin, white clay, talc, titanium oxide, diatomaceous earth, barium sulfate, aluminum hydroxide, magnesium hydroxide, calcinated clay, calcinated kaolin, delaminated kaolin, heavy calcium carbonate, light calcium carbonate, magnesium carbonate, barium carbonate, zinc oxide, silicon oxide, amorphous silica, aluminum hydroxide, calcium hydroxide, zinc hydroxide, urea-formaldehyde resins, polystyrene resins, phenol resins and hollow fine particles.

Examples of the dry paper reinforcers include cationic starch, cationic polyacrylamide, anionic polyacrylamide, amphoteric polyacrylamide and carboxy-modified polyvinyl alcohol.

Examples of the sizing agents include higher fatty acid salts; rosin derivatives such as rosin and maleic rosin; paraffin wax, alkyl ketene dimer, alkenyl succinic anhydride (ASA); and higher fatty acid such as epoxidized fatty amide.

Examples of the wet paper reinforcers include polyamine polyamide epichlorohydrin, melamine resins, urea resins, and epoxy polyamide resins.

Examples of the fixing agents include polyvalent metal salts such as aluminum sulfate and aluminum chloride; basic aluminum compounds such as sodium aluminate, basic aluminum chloride and basic polyaluminum hydroxide; polyvalent metal compounds such as ferrous sulfate and ferric sulfate; starch, processed starch, polyacrylamide, urea resins, melamine resins, epoxy resins, polyamide resins, polyamine resins, polyethylene imine, vegetable gum; water-soluble polymers such as polyethylene oxide; cationic polymers such as cationic starch; dispersions of hydrophilic crosslinking polymer particles; and various compounds such as derivatives and modified products thereof.

Examples of the pH regulators include caustic soda and sodium carbonate.

Examples of other agents include defoaming agents, dyes, slime control agents and fluorescent whitening agents.

In accordance with the necessity, the pulp slurry may contain a flexibilizer. Examples of the flexibilizer include those described in the literature "Paper and Paper Treatment Manual (published by Shiyaku Time Co., Ltd., 1980, pp. 554-555).

These various additives may be used alone or in combination of two or more. The amount of these various additives to be added to the pulp paper material, which may be suitably selected in accordance with the intended use, is preferably 0.1% by mass to 1.0% by mass.

The pulp paper material which is optionally prepared by incorporating the various additives into the pulp slurry is subjected to the papermaking using paper machines such as manual paper machines, Fourdrinier (long-net) paper machines, round-net paper machines, twin-wire machines and combination machines, and the resulting product is dried to produce the raw paper. The resulting paper may be optionally treated with surface sizing, before or after the drying of the resulting paper.

The liquid used for the surface sizing treatment may be properly selected depending on the application; examples of compounds in the treating liquid are water-soluble polymers, waterproof compounds, pigments, dyes and fluorescent whitening agents.

Examples of the water-soluble polymer include cationic starch, polyvinyl alcohol, carboxy-modified polyvinyl alcohol, carboxymethylcellulose, hydroxyethylcellulose, cellulose sulfate, gelatin, casein, sodium polyacrylate, sodium salts of styrene-maleic anhydride copolymer and sodium salts of polystyrene sulfonic acid.

Examples of the waterproof compound include latexes and emulsions, such as styrene-butadiene copolymers, ethylene-vinyl acetate copolymers, polyethylene and vinylidene chloride copolymer; and polyamide polyamine epichlorohydrin.

Examples of the pigment include calcium carbonate, clay, kaolin, talc, barium sulfate and titanium oxide.

From the viewpoint of improving stiffness and dimension stability (curling properties) of the raw paper, it is preferred that the raw paper has the ratio (Ea/Eb) between the longitudinal Young's modulus (Ea) and the lateral Young's modulus (Eb) of from 1.5 to 2.0. When the ratio (Ea/Eb) is less than 1.5 or more than 2.0, the stiffness and the curling properties of the electrophotographic image-receiving sheet may be easily impaired, and then a disadvantage is caused wherein the transportability of the electrophotographic image-receiving sheet is hindered.

It has been demonstrated that the paper "nerve" depends on the pulp beating processes and the elastic modulus of paper produced by papermaking after the pulp beating can be used as an important index of the paper "nerve". The elastic modulus of paper can be calculated based on the relation between dynamic elastic modulus and density and measurement of an acoustic velocity in the paper using an ultrasonic oscillator, specifically from the following equation:

$$E=\rho c^2(1-n^2)$$

where "E" represents dynamic elastic modulus, "ρ" represents the density of the paper, "c" represents the acoustic velocity in the paper, and "n" represents Poisson's ratio.

Since "n" is about 0.2 in regular paper, the calculation from the following equation is allowable.

$$E=\rho c^2$$

As such, the measurements of density and acoustic velocity of a paper may easily result in the elastic modulus. The acoustic velocity may be measured by Sonic Tester SST-110 (by Nomura Shoji Co., Ltd.), for example.

The thickness of the raw paper may be properly selected depending on the application; the thickness is preferably 30 to 500 μm, more preferably 50 to 300 μm, and still more preferably 100 to 250 μm. The basis weight may also be properly selected depending on the application; the thickness is preferably 50 to 250 g/m$^2$, and more preferably 100 to 200 g/m$^2$.

The raw paper is preferably calender-treated such that a metal roller contacts with the surface of raw paper on which the toner image-receiving layer being disposed.

The surface temperature of the metal roller is preferably 100° C. or higher, more preferably 150° C. or higher, and still more preferably 200° C. or higher. The maximum surface temperature of metal rollers may be properly selected depending on the application; typically, the maximum temperature is about 300° C.

The nip pressure at the calender treatment may be properly selected depending on the application; preferably, the pressure is 100 kN/cm$^2$ or more, and more preferably 100 kN/cm$^2$ to 600 kN/cm$^2$.

The calender used in the treatment described above may be properly selected depending on the application; examples thereof include soft calender rollers in combination of a metal roller and a synthetic resin roller and machine calender rollers containing a pair of metal rollers. Of these, calenders having a soft calender roller are preferable, and particularly preferable are shoe calenders with a long nip consisting of a metal roll and a shoe roll through a synthetic resin belt.

Synthetic Paper

The synthetic paper is one that is mainly composed of polymer fiber other than cellulose. Examples the polymer fiber include polyolefin fibers such as polyethylene and polypropylene.

Synthetic Resin Sheet or Film

The synthetic resin sheet or film includes synthetic resins in a sheet form; examples thereof include polypropylene film, stretched polyethylene film, stretched polypropylene film, polyester film, stretched polyester film, nylon film, white-colored film by stretching and white film containing a white pigment.

Coated Paper

The coated paper is one produced by coating various resins, rubber latexes, or polymers on one or both surfaces of substrates such as raw paper, and the coating amount differs depending on the application. Examples of the coated paper include art paper, cast coated paper, and Yankee paper.

The resins coated on the surface of the raw paper are favorably exemplified by thermoplastic resins (i) to (viii).

(i) Polyethylene resins, polyolefin resins such as polypropylene reins, copolymer resins of olefins like ethylene or propylene and other vinyl monomers, and acrylic resins;

(ii) Thermoplastic resins having an ester bond are available such as polyester resins prepared from condensation of dicarboxylic acid compounds, which may be substituted by sulfonic acid or carboxylic acid group, and alcohol compounds, which may be substituted by a hydroxyl group; polyacrylate or polymethacrylate resins such as polymethylmethacrylate, polybutylmethacrylate, polymethylacrylate and polybutylacrylate; polycarbonate resins, polyvinyl acetate resins, styrene acrylate resins, styrene-methacrylate copolymer resins, and vinyltoluene-acrylate resins; more specifically, those described in JP-A Nos. 59-101395, 63-7971, 63-7972, 63-7973 and 60-294862;

in addition, commercially available ones are exemplified such as Vylon 290, 200, 280, 300, 103, GK-140 and GK-130 (by Toyobo Co.); Tuftone NE-382, Tuftone U-5, ATR-2009 and ATR-2010 (by Kao Corporation); Elitel UE3500, UE3210, XA-8153, KZA-7049 and KZA-1449 (by Unitika Ltd.); Polyster TP-220, R-188 (by Nippon Synthetic Chemical Industry Co.); and Hiros series (by Seiko Chemical Industries Co.);

(iii) Polyurethane resins;

(iv) Polyamide resins, urea resins;

(v) Polysulfone resins;

(vi) Polyvinyl chloride resins, polyvinylidene chloride resins, vinyl chloride-vinyl acetate copolymer resins, and vinyl chloride-vinylpropionic acid copolymer resins;

(vii) Polyol resins such as polyvinylbutyral; cellulose resins such as ethylcellulose resins and cellulose acetate resins;

(viii) Polycaprolactone resins, styrene-maleic anhydride resins, polyacrylonitrile resins, polyether resins, epoxy resins, and phenol resins.

These thermoplastic resins may be used alone or in combination. The thermoplastic resins may optionally contain fluorescent whitening agents, conductive agents, fillers, and pigments or dyes such as titanium oxide, ultramarine blue and carbon black.

Laminated Paper

The laminated paper is one produced by laminating resin, rubber or polymer sheets or films on sheets as raw paper. The materials for producing the laminated paper are exemplified by polypropylene, polyvinyl chloride, polyethylene terephthalate, polystyrene, polymethacrylate, polycarbonates, polyamides, or triacetyl cellulose. These resins may be used alone or in combination.

The polyolefin resin is often formed by using low density polyethylene resin; in order to increase the heat resistance of the support, it is preferable to use polypropylene, a blend of polypropylene and polyethylene, high-density polyethylene, and a blend of high-density polyethylene and low-density polyethylene. From the view point of cost and laminated properties, the blend of high-density polyethylene and low-density polyethylene is preferably used in particular.

The high-density polyethylene and the low-density polyethylene preferably have a blend ratio by mass of 1/9 to 9/1, more preferably 2/8 to 8/2, and still more preferably 3/7 to 7/3. When forming thermoplastic resin layer on both sides of the raw paper, high-density polyethylene or a blend of high-density polyethylene and low-density polyethylene is formed at the back surface of the raw paper opposite to the image-receiving layer. The high-density polyethylene and low-density polyethylene preferably have a melt index of 1.0 g/10 min to 40 g/10 min and appropriate extrusion ability.

The sheet or film may be treated to reflect white color; for example, the sheet or film is compounded a pigment such as titanium oxide for the purpose.

It is preferred that two or more of polyolefin resin layers exist at the front side to dispose the toner image-receiving layer and the density of the outermost polyolefin resin layer at the distal site from raw paper is lower than the density of at least one polyolefin resin layer other than the outermost polyolefin resin layer. The combination of the polyolefin resin layer and the toner image-receiving layer may favorably exhibit excellent adhesion resistance, low-temperature fixability and foaming or blister resistance at high temperature fixing.

It is also preferred that two or more of polyolefin resin layers exist at the front side to dispose the toner image-receiving layer and the propylene content of the outermost polyolefin resin layer at the distal site from raw paper is lower than the content of at least one polyolefin resin layer other than the outermost polyolefin resin layer. The combination of the polyolefin resin layer and the toner image-receiving layer may favorably exhibit excellent adhesion resistance, low-temperature fixability and foaming or blister resistance at high temperature fixing.

The thickness of the support may be properly selected depending on the purpose; preferably, the thickness is 25 μm to 300 μm, more preferably 50 μm to 260 μm, still more preferably 75 μm to 220 μm.

Other Layers

The other layers in the electrophotographic electrophotographic image-receiving sheet are exemplified by a back layer, surface-protecting layer, adhesion-improving layer, intermediate layer, cushion layer, charge-controlling layer, reflective layer, tint-controlling layer, shelf stability-improving layer, anti-adhesion layer, anti-curling layer and smoothing layer. These layers may be formed of one or more layers.

Back Layer

In the inventive electrophotographic image-receiving sheet, the back layer may be disposed at the side of the support opposite to the toner image-receiving layer for the purpose of improving back side-output suitability, image quality of the back side-output, curling balance and transportability.

The color of the back layer may be properly selected depending on the application; when the inventive electrophotographic image-receiving sheet is used to form images on both sides, the color of the back layer is preferably white. The whiteness and the spectral reflectance of the back layer are preferably 85% or more similarly as the front side.

In view of both-side output suitability, the back layer may have the same constitution as that of the toner image-receiving layer. The back layer may contain various additives described with respect to the toner image-receiving layer; preferably, a matting agent and a charge control agent are compounded. The back layer may have a single-layer or a laminated structure of two or more layers.

When a release oil is applied to fixing rollers for preventing offset during the image fixing, the back layer may have oil absorbency. The thickness of the back layer is preferably 0.1 μm to 10 μm.

Surface Protective Layer

The surface protective layer may be disposed on the surface of the toner image-receiving layer for protecting the surface of the inventive electrophotographic image-receiving sheet, improving shelf stability, handling properties and transportability, and imparting writing properties and anti-offset properties thereto. The surface protective layer may have a single-layer or a laminated structure of two or more layers. The surface protective layer may contain as a binder resin at least one of various thermoplastic resins and thermosetting resins, which is preferably of the same type as that of the resin used for the toner image-receiving layer. In this case, the resin used for the surface protective layer is not required to have the same thermodynamic properties or electrostatic properties as those of the resin used for the toner image-receiving layer, i.e. those properties may be independently optimized.

The surface protective layer may contain the above-noted various additives for the toner image-receiving layer. Particularly, the surface protective layer may contain other additives such as a matting agent together with the above-noted releasing agent used in the present invention. Examples of the matting agent include various conventional ones. The outermost surface layer of the electrophotographic image-receiving sheet, e.g. the surface protective layer when disposed, has preferably good compatibility with the toner from the viewpoint of good fixability of the toner image. More specifically, the outermost surface layer has preferably a contact angle of from 0° to 40° with the molten toner.

Intermediate Layer

The intermediate layer may be formed, for example, between the support and the adhesion-improving layer, between the adhesion-improving layer and the cushion layer, between the cushion layer and the toner image-receiving layer, or between the toner image-receiving layer and the shelf stability improving layer. When the electrophotographic image-receiving sheet contains the support, the toner image-receiving layer and the intermediate layer, the intermediate layer may be disposed, for example, between the support and the toner image-receiving layer.

Adhesion-Improving Layer

The adhesion-improving layer in the inventive electrophotographic image-receiving sheet is preferably disposed for improving adhesion between the support and the toner image-receiving layer. The adhesion-improving layer may contain the above-noted various additives, particularly preferably the crosslinker.

Further, it is preferred for the inventive electrophotographic image-receiving sheet that, in view of improving the toner receptivity, a cushion layer is disposed between the adhesion improving layer and the image-receiving layer.

The thickness of the inventive electrophotographic image-receiving sheet may be properly selected depending on the application; the thickness is preferably from 50 μm to 550 μm, and more preferably from 100 μm to 350 μm.

Method for Producing Electrophotographic Image-Receiving Sheet

The inventive method for producing an electrophotographic image-receiving sheet comprises at least a step of forming a toner image-receiving layer and other optional steps as required.

In the step for forming a toner image-receiving layer, a coating liquid for toner image-receiving layer is coated on a support that contains a crystalline polymer aqueous dispersion comprising a crystalline polymer, a basic compound, and water to form a toner image-receiving layer. Consequently, much energy and/or large scale systems are unnecessary for forming the toner image-receiving layer, and environmentally harmful organic solvents such as of organic solvent-coating processes are also unnecessary, which leading to minimize the environmental load. In addition, the toner image-receiving sheet may be easily formed without diminishing the crystallinity of the crystalline polymer, which may promote the sharp-melting property of the toner image-receiving layer, provide the adhesion resistance as well as low temperature fixability, and avoid the adhesion with production lines in the production processes.

The coating process of the toner image-receiving layer may be conventional ones; the coating process may be carried out using, for example, roll coaters, reverse roll coaters, gravure coaters, extrusion die coaters, curtain flow coaters, spray coaters, blade coaters, rod coaters, immersion coaters, cast coaters, air knife coaters, squeeze coaters and bar coaters. Among these, extrusion die coaters, curtain flow coaters and bar coaters are particularly preferable from the view point of controlling the coating amount and the surface condition of coated films.

The toner image-receiving layer may be dried by conventional drying processes. The drying temperature is preferably 60° C. to 120° C., more preferably 70° C. to 100° C. The drying temperature of below 60° C. may result in insufficient drying, and the temperature above 120° C. may deform the support, deteriorate surface condition, and/or generate transportation problems or adhesion with production lines due to insufficient cooling. The drying period, which being properly selected depending on the application, is preferably 10 seconds to 3 minutes. The drying period shorter than 10 seconds may result in insufficient drying, and the period longer than 3 minutes may deform the support and/or deteriorate surface condition.

Toner

The inventive electrophotographic image-receiving sheet is used in a manner that the toner image-receiving layer receives a toner during printing or copying processes. The toner comprises at least a binder resin and a colorant, and optionally a releasing agent and other components.

Binder Resin for Toner

The binder resin may be properly selected from those conventionally used for producing toners depending on the application. Examples of the binder resin include homo-polymers or copolymers of vinyl monomers such as styrene and parachlorostyrene; vinyl esters such as vinyl naphthalene, vinyl chloride, vinyl bromide, vinyl fluoride, vinyl acetate, vinyl propioniate, vinyl benzoate and vinyl butyrate; methylene fatty carboxylate esters such as methyl acrylate, ethyl acrylate, n-butyl acrylate, isobutyl acrylate, dodecyl acrylate, n-octyl acrylate, 2-chloroethyl acrylate, phenyl acrylate, methyl α-chloroacrylate, methyl methacrylate, ethyl methacrylate and butyl methacrylate; vinyl nitriles such as acrylonitrile, methacrylonitrile and acrylamide; vinyl ethers such as vinyl methyl ether, vinyl ethyl ether and vinyl isobutyl ether; N-vinyl compounds such as N-vinyl pyrrole, N-vinyl carbazole, N-vinyl indole and N-vinyl pyrrolidone; and vinyl carboxylic acids such as methacrylic acid, acrylic acid and cinnamic acid, and also various polyesters. These binder resins may be used in combination with various waxes.

Among these resins, the same type as that of the toner image-receiving layer is preferably used.

Colorant for Toner

The colorant may be properly selected from those conventionally used for producing toners depending on the application. Examples of the colorant include various pigments such as carbon black, chrome yellow, hansa yellow, benzidine yellow, threne yellow, quinoline yellow, Permanent Orange GTR, Pyrazolone orange, vulcan orange, watchung red, permanent red, Brilliant Carmine 3B, Brilliant Carmine 6B, Du Pont Oil Red, Pyrazolone Red, Lithol Red, Rhodamine B lake, Lake Red C, Rose Bengal, aniline blue, ultra marine blue, chalco oil blue, methylene blue chloride, phthalocyanine blue, phthalocyanine green, malachite green oxalate; and various dyes such as acridine dyes, xanthene dyes, azo dyes, benzoquinone dyes, azine dyes, anthraquinone dyes, indigo dyes, thioindigo dyes, dioxazine dyes, thiazine dyes, azomethine dyes, phthalocyanine dyes, aniline black dyes, polymethine dyes, triphenylmethane dyes, diphenylmethane dyes, and thiazole dyes. These colorants may be used alone or in combination of two or more.

The content of the colorant may be properly selected depending on the application. The content is preferably from 2 to 8% by mass, based on the mass of the toner. The colorant content less than 2% by mass may be lack in tinting strength, and the content more than 8% by mass may impair the toner clarity.

Releasing Agent for Toner

The releasing agent may be properly selected from conventional ones for toners; particularly preferable are high-crystalline polyethylene waxes with lower molecular masses, Fischer-Tropsch wax, amide waxes and nitrogen-containing polar waxes such as compounds having a urethane bond. The polyethylene wax has a molecular mass of preferably 1000 or less, and more preferable from 300 to 1000.

The compounds having a urethane bond are advantageous since the compounds may maintain a solid state due to a strong cohesive force derived from the polar group and have a higher melting point regardless of the lower molecular masses. The compounds preferably have a molecular mass of 300 to 1000. The raw materials for producing the compounds having a urethane bond are exemplified by combinations of a diisocyanic acid and a monohydric alcohol, a monoisocyanic acid and a monohydric alcohol, a dihydric alcohol and a monoisocyanic acid, a trihydric alcohol and a monoisocyanic acid, and a triisocyanic acid and a monohydric alcohol. In order to prevent the excessively large molecular mass, combination of compounds having a multiple functional group and compounds having a single functional group are preferable, and it is important that their functionalities are equivalent.

Examples of the monoisocyanic acid include dodecyl isocyanate, phenyl isocyanate (and derivatives thereof), naphthyl isocyanate, hexyl isocyanate, benzyl isocyanate, butyl isocyanate and allyl isocyanate.

Examples of the diisocyanic acid include tolylene diisocyanate, 4,4'-diphenylmethane diisocyanate, toluene diisocyanate, 1,3-phenylene diisocyanate, hexamethylene diisocyanate, 4-methyl-m-phenylene diisocyanate and isophorone diisocyanate.

Examples of the monohydric alcohol include methanol, ethanol, propanol, butanol, pentanol, hexanol and heptanol.

Examples of the dihydric alcohol include various glycols such as ethylene glycol, diethylene glycol, triethylene glycol and trimethylene glycol; examples of the trihydric alcohol include trimethylol propane, triethylol propane and trimethanol ethane.

These urethane compounds may be mixed with a resin or a colorant during kneading processes similarly as conventional releasing agents. In cases used with toners that are produced through emulsion polymerization, coagulation and melting processes, these urethane compounds may be used in such a manner as dispersing into water with an ionic surfactant or a polymer electrolyte like polymeric acids and polymeric bases, heating above its melting point, micronizing under a strong shear force by use of a homogenizer or a pressure-discharging dispersing device, thereby to prepare a releasing agent dispersion having a particle size of 1 μm or less, then the dispersion is used with a dispersion of resin particles and/or colorant dispersion.

Other Components of Toner

The toner may contain other components such as an inner additive, a charge control agent and inorganic fine particles. Examples of the inner additive include magnetic materials like metals such as ferrite, magnetite, reduced iron, cobalt, nickel and manganese, alloys thereof, and compounds containing these metals.

Examples of the charge control agent include conventional charge control agents such as quaternary ammonium salts, nigrosine compounds, dyes containing a metal complex of such as of aluminum, iron and chromium and triphenylmethane pigments. It is preferred that the charge control agent is hardly water-soluble from the view point of controlling ion strength possibly affecting the stability of during the coagulation and the melting and reducing the waste water pollution.

Examples of the inorganic fine particles are any conventional external additives as regarding the toner surface, such as silica, alumina, titania, calcium carbonate, magnesium carbonate and tricalcium phosphate. These particles are preferably used in a form of a dispersion produced by dispersing the particles with an ionic surfactant, a polymer acid or a polymer base.

Further, the toner may contain a surfactant with an aim of emulsion polymerization, seed emulsion polymerization, pigment dispersion, resin particles dispersion, releasing agent dispersion, cohesion and stabilization thereof. Examples of the surfactant include anionic surfactants such as sulfate esters, sulfonate esters, phosphate esters and soaps; cationic surfactants such as amine salts and quaternary ammonium salts. These surfactants may be effectively combined with nonionic surfactants such as polyethylene glycol, alkylphenol ethylene oxide adducts and polyhydric alcohols. The device for dispersing the surfactant in the toner may be conventional ones such as rotary shearing homogenizers, ball mills, sand mills and dyno mills, all of which contain specific dispersing and/or milling media.

The toner may comprise optionally another external additive, which may be inorganic or organic particles. Examples of the inorganic particles include particles of $SiO_2$, $TiO_2$, $Al_2O_3$, CuO, ZnO, $SnO_2$, $Fe_2O_3$, MgO, BaO, CaO, $K_2O$, $Na_2O$, $ZrO_2$, $CaO.SiO_2$, $K_2O.(TiO_2)_n$, $Al_2O_3.2SiO_2$, $CaCO_3$, $MgCO_3$, $BaSO_4$ and $MgSO_4$. Examples of the organic particles include particles of fatty acids and derivatives thereof; metal salts of the fatty acid and derivatives thereof; and resins such as fluorine resins, polyethylene resins and acrylic resins. The average particle diameter of these particles is preferably from 0.01 μm to 5 μm, more preferably from 0.1 μm to 2 μm.

The method for producing the toner may be properly selected depending on the application; preferably, the method include (i) preparing a cohesive particle dispersion by forming cohesive particles in a resin particle dispersion, (ii) forming attached particles by mixing the cohesive particle dispersion with a fine particle dispersion so that the fine particles attach to the cohesive particles and (iii) forming toner particles by heating and melting the attached particles.

Toner Properties

The toner in the present invention preferably has a volume average particle diameter of 0.5 μm to 10 μm. When the volume average particle diameter of the toner is excessively small, toner handling properties such as replenish properties, cleaning properties and fluidity may be poor and the particle productivity may be lowered. In contrast, when the volume average particle diameter of the toner is excessively large, the quality and resolution of images may be affected adversely due to graininess and transferability.

It is preferred that the toner in the present invention satisfies the range of the volume average particle diameter and has a distribution index of the volume average particle diameter (GSDv) of 1.3 or less.

The ratio (GSDv/GSDn) of the distribution index of the volume average particle diameter (GSDv) to the distribution index of the number average particle diameter (GSDn) is preferably 0.95 or more.

It is preferred that the toner in the present invention satisfies the above-noted range of the volume average particle diameter and has an average of 1.00 to 1.50 in terms of the shape factor calculated from the following equation:

$$\text{Shape factor}=(\pi\times L^2)/(4\times S)$$

wherein L represents the maximum length of the toner particles and S represents the projected area of the toner particles.

When the toner satisfies the relation, image quality such as graininess and resolution may be improved, dropout or blur during transferring steps may be suppressed, and handling properties of the toner may be free from adverse effects regardless of the average particle diameter.

From the viewpoint of improving the image quality and preventing the offset during the image-fixing, it is preferred that the toner has a storage elastic modulus G' of $1\times10^2$ Pa to $1\times10^5$ Pa at 150° C. as measured at an angular frequency of 10 rad/sec.

Image Forming Process

The process of forming an image on the inventive electrophotographic image-receiving sheet includes forming the toner image, fixing the image and smoothing the image surface, and other steps as required.

Image Forming Process

Toner images may be formed on the inventive electrophotographic image-receiving sheet in an image forming process.

The image forming process may be properly selected depending on the application; for example, conventional electrophotographic processes may be available, such as direct transfer processes in which a toner image on a developing roller is directly transferred to the electrophotographic image-receiving sheet and intermediate transfer belt processes in which a toner image on a developing roller is primary-transferred to an intermediate transfer belt and the primary-transferred image is transferred to the electrophotographic image-receiving sheet. Among these, the intermediate transfer belt processes are preferably employed from the viewpoint of environmental stability and high image quality.

Fixing and Smoothing Image Surface

The fixing of the toner image and the smoothing the toner image surface are conducted for the toner image resulting from the image forming process by way of heating, pressurizing and cooling the toner image and then peeling the electrophotographic image-receiving sheet using an apparatus configured to fix the toner image and to smooth the toner image surface, which is equipped with a heating-pressurizing unit, a belt, a cooling unit and optional other units.

The heating-pressurizing unit may be properly selected depending on the application and exemplified by a pair of heat rollers or combinations of heat rollers and pressurizing rollers. The cooling unit may be properly selected depending on the application and exemplified by cooling units that blow a cool air and control the cooling temperature, and heat sinks.

The cooling-peeling site may be properly selected depending on the application and exemplified by a section near a tension roller where the electrophotographic image-receiving sheet is peeled from a belt by virtue of its stiffness or nerve.

The image-receiving sheet is preferably pressurized, when contacting the toner image with a heating-pressurizing unit of the apparatus configured to fix the image and to smooth the image surface. The method for pressurizing the image-receiving sheet may be properly selected depending on the application; preferably, a nip pressure is employed. The nip pressure is preferably 1 kgf/cm$^2$ to 100 kgf/cm$^2$, more preferably 5 kgf/cm$^2$ to 30 kgf/cm$^2$ from the viewpoint of images with excellent water resistance, surface smoothness and high gloss. The heating temperature in the heating-pressurizing unit is no lower than the softening point of the polymer in the toner image-receiving layer and typically depends on the polymer in the toner image-receiving layer; preferably, the temperature is 80° C. to 200° C. The cooling temperature in the cooling unit is preferably no higher than 80° C. at which the toner image-receiving being solidified, more preferably from 20° C. to 80° C.

The belt contains a support film and a releasing layer disposed on the support film.

The material for the support film may be suitably selected depending on the application from those of heat resistant; examples thereof include polyimide (PI), polyethylene naphthalate (PEN), polyethylene terephthalate (PET), polyether ether ketone (PEEK), polyether sulfone (PES), polyether imide (PEI) and polyparabanic acid (PPA).

The releasing layer preferably contains at least one selected from the group consisting of silicone rubbers, fluorine rubbers, fluorocarbon siloxane rubbers, silicone resins and fluorine resins. Preferably, a fluorocarbon siloxane rubber-containing layer is disposed on the surface of the belt support; or a silicone rubber-containing layer is disposed on the surface of the belt and a fluorocarbon siloxane rubber-containing layer is further disposed on the surface of the silicone rubber-containing layer.

The fluorocarbon siloxane rubber in the fluorocarbon siloxane rubber-containing layer has preferably in the main chain thereof at least one of a perfluoroalkyl ether group and a perfluoroalkyl group.

The fluorocarbon siloxane rubber is preferably a cured product of a fluorocarbon siloxane rubber composition containing the following components (A)-(D):

(A) a fluorocarbon polymer containing mainly a fluorocarbon siloxane represented by the following General Formula (1) and having an unsaturated fatty hydrocarbon group, (B) at least one of organopolysiloxane and fluorocarbon siloxane which have two or more ═SiH groups in the molecule, wherein the amount of a ═SiH group is from one to four times by mole the amount of the unsaturated fatty hydrocarbon group in the above-noted fluorocarbon siloxane rubber composition, (C) a filler, and (D) an effective amount of catalyst.

The fluorocarbon polymer as the component (A) contains mainly a fluorocarbon siloxane containing a recurring unit represented by the following General Formula (1) and contains an unsaturated fatty hydrocarbon group.

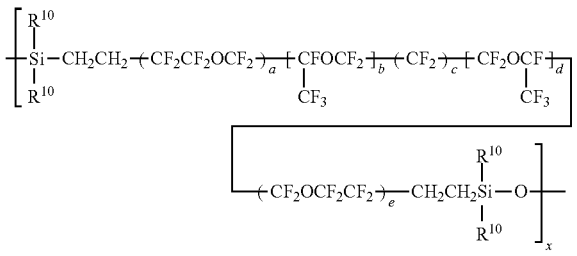

In General Formula (1), $R^{10}$ represents an unsubstituted or substituted monovalent hydrocarbon group having 1 to 8 carbon atoms and is preferably an alkyl group having 1 to 8 carbon atoms or a alkenyl group having 2 to 3 carbon atoms, most preferably a methyl group; "a" and "e" are each an integer of 0 or 1, "b" and "d" are each an integer of 1 to 4 and "c" is an integer of 0 to 8; and "x" is preferably an integer of 1 or more, more preferably an integer of 10 to 30.

Examples of the component (A) include a compound represented by the following General Formula (2):

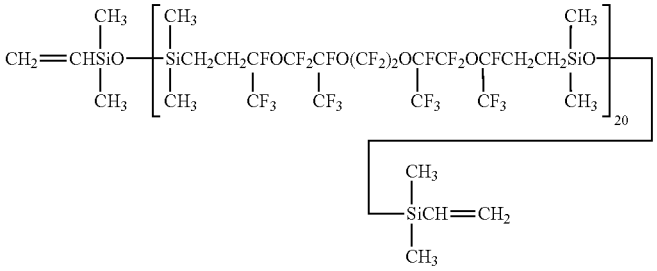

With respect to the component (B), examples of the organopolysiloxane having ═SiH groups include an organohydrogen polysiloxane having in the molecule at least two hydrogen atoms bonded to a silicon atom.

In the fluorocarbon siloxane rubber composition, when the fluorocarbon polymer as the component (A) has an unsaturated fatty hydrocarbon group, as a curing agent, the above-noted organohydrogen polysiloxane is preferably used. In other words, the cured form is produced by an addition reaction between the unsaturated fatty hydrocarbon group of the fluorocarbon siloxane and a hydrogen atom bonded to a silicon atom in the organohydrogen polysiloxane.

Examples of the organohydrogen polysiloxane include various organohydrogen polysiloxanes used for curing a silicone rubber composition which is cured by an addition reaction.

The amount of the organohydrogen polysiloxane is preferably such that the number of ═SiH groups is at least one, more preferably from 1 to 5 relative to one unsaturated fatty hydrocarbon group in the fluorocarbon siloxane of the component (A).

With respect to the component (B), preferable examples of the fluorocarbon siloxane having the ═SiH groups are a fluorocarbon siloxane having a structure of the recurring unit represented by the General Formula (1), and a fluorocarbon siloxane having a structure of the recurring unit represented by the General Formula (1) in which $R^{10}$ is a dialkylhydrogen siloxy group and the terminal group is a ═SiH group, such as a dialkylhydrogen siloxy group or a silyl group. Such a preferable fluorocarbon siloxane may be represented by the following General Formula (3).

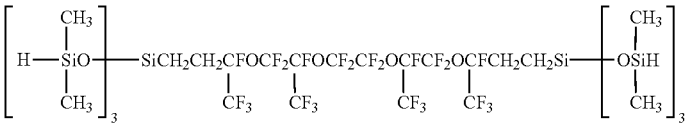

Various fillers for conventional silicone rubber compositions may be used for the filler in the component (C); examples of the filler include aerosol silica, precipitated silica, carbon powder, titanium dioxide, aluminum oxide, quartz powder, talc, sericite and bentonite; and fiber fillers such as asbesto, glass fibers and organic fibers.

The catalyst for the component (D) are exemplified by conventional ones for addition reaction like VIII group elements in Periodic Table and compounds thereof; specific examples thereof include chloroplatinic acid, alcohol-modified chloroplatinic acid, complexes of chloroplatinic acid with olefins; platinum black or palladium supported on carriers such as alumina, silica and carbon; complexes of rhodium with olefins; chlorotris(triphenylphosphine) rhodium (Wilkinson catalyst) and rhodium (III) acetyl acetonate. It is preferred that these complexes are dissolved in a solvent such alcohols, ethers and hydrocarbons.

The fluorocarbon siloxane rubber composition may be properly selected depending on the application, and optionally may contain various additives. Examples of the additives include dispersing agents such as a diphenylsilane diol, lower molecular mass dimethylpolysiloxanes with an end-blocked hydroxyl group, and hexamethyldisilazane; heat resistance improver such as ferrous oxide, ferric oxide, cerium oxide and iron octylate; and colorants such as pigments.

The belt may be produced by coating the surface of a heat-resistant support film with the fluorocarbon siloxane rubber composition and curing and heating the surface of the resultant coated support film. Optionally, the belt may be produced by coating the surface of the support film with a coating solution prepared by diluting the fluorocarbon siloxane rubber composition with a solvent such as m-xylene hexafluoride and benzotrifluoride according to conventional coating processes such as spray coating, dip coating and knife coating. The heating-curing temperature and time may be properly selected from the from 100° C. to 500° C. and from 5 seconds to 5 hours depending on the type of the support film and the production process of the belt.

The thickness of the releasing layer disposed on the surface of the heat-resistant support film may be properly selected depending on the application; the thickness is preferably from 1 μm to 200 μm, more preferably from 5 μm to 150 μm in view of appropriate image fixability while maintaining toner release properties and preventing toner offset.

An apparatus to fix images and to smooth the surface thereof available in the present invention will be exemplarily explained in the following with reference to FIG. 1.

First, a toner 12 is transferred to an electrophotographic image-receiving sheet 1 in an image forming apparatus (not shown). The electrophotographic image-receiving sheet 1, on which the toner 12 being disposed, is conveyed to the point A by a conveying unit (not shown) and passes through between a heat roller 14 and a pressurizing roller 15 at the fixing temperature a pressure, wherein the temperature and pressure are enough high to soften the toner image-receiving layer of the electrophotographic image-receiving sheet 1 or the toner 12.

The fixing temperature refers to that of the surface of the toner image-receiving layer at a nip space of point A between the heat roller 14 and the pressurizing roller 15; the fixing temperature is preferably from 80° C. to 190° C., more preferably from 100° C. to 170° C. The fixing pressure refers to that on the surface of the toner image-receiving layer also at a nip space of point A between the heat roller 14 and the pressurizing roller 15; the fixing pressure is preferably from 1 kgf/cm$^2$ to 10 kgf/cm$^2$, more preferably from 2 kgf/cm$^2$ to 7 kgf/cm$^2$.

The heated and pressurized electrophotographic image-receiving sheet 1 is then conveyed by a fixing belt 13 to a cooling unit 16 and while conveying the electrophotographic image-receiving sheet 1, in the electrophotographic image-receiving sheet 1, a mold-releasing agent (not shown) dispersed in the toner image-receiving layer is well heated and molten. The molten mold-releasing agent is gathered to the surface of the toner image-receiving layer so that in the surface of the toner image-receiving layer, a layer or a film of the mold-releasing agent is formed. The electrophotographic image-receiving sheet 1 is then conveyed to the cooling unit 16 by the fixing belt 13 and then cooled by the cooling unit 16 to a temperature, for example, no higher than either the softening point of the binder resin in the toner image-receiving layer or the toner, or to a temperature lower than the glass transition point of the above-noted binder resin plus 10° C., wherein the temperature to which the electrophotographic image-receiving sheet 1 is cooled is preferably from 20° C. to 80° C., more preferably room temperature. Thus the layer or film of the mold-releasing agent formed in the surface of the toner image-receiving layer is cooled and solidified, thereby forming the mold-releasing agent layer.

The cooled electrophotographic image-receiving sheet 1 is conveyed by the fixing belt 13 further to the point B and the fixing belt 13 moves along the tension roller 17. Accordingly, at the point B, the electrophotographic image-receiving sheet 1 is peeled from the fixing belt 13. It is preferred that the diameter of the tension roller 17 is so small designed that the electrophotographic image-receiving sheet can be peeled from the fixing belt 13 by own stiffness or nerve.

Figure 2:
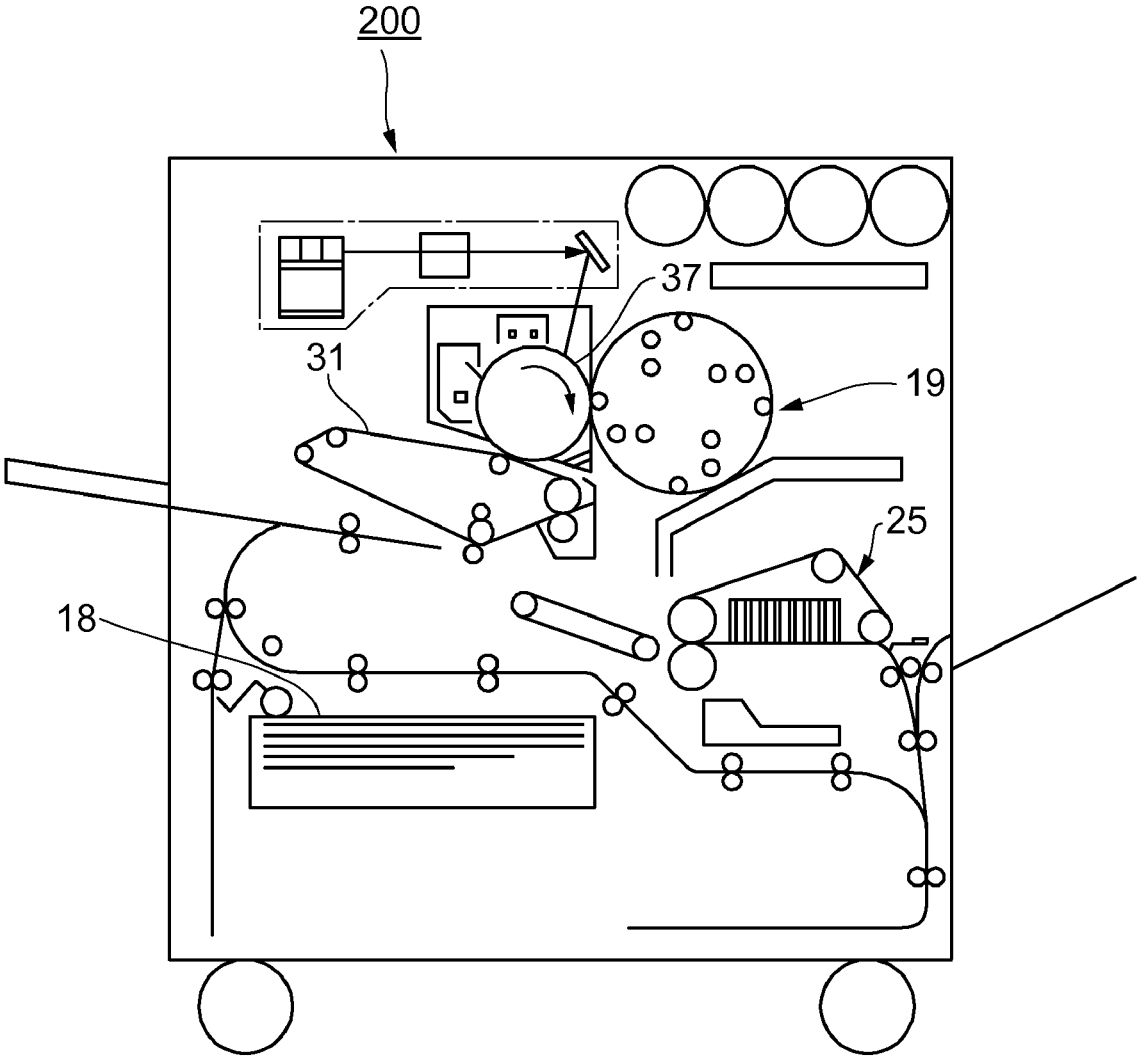
FIG. 2 is a schematic view that exemplarily shows an image forming apparatus available in the present invention.
Figure 3:
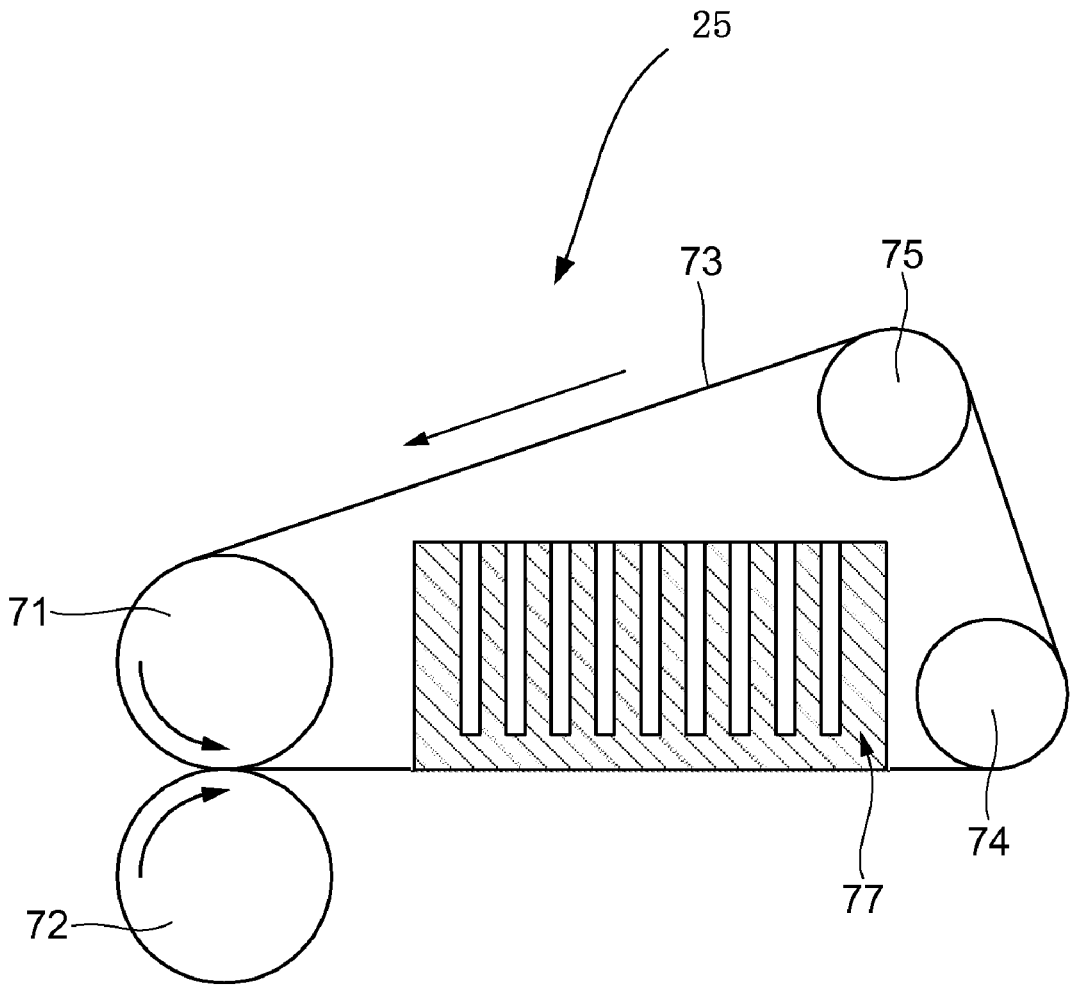
FIG. 3 is a schematic view that exemplarily shows another apparatus to fix images and to smooth the surface thereof adapted to the image forming apparatus of FIG. 2.

The apparatus configured to fix an image and to smooth the image surface shown in FIG. 3 may be modified and used for the image forming apparatus (e.g., a full-color laser printer DCC-500, by Fuji Xerox Co.) shown in FIG. 2 by converting the image forming apparatus to a part of the belt fixing in the image forming apparatus.

As shown in FIG. 2, an image forming apparatus 200 is equipped with a photoconductive drum 37, a development device 19, an intermediate transfer belt 31, an electrophotographic image-receiving sheet 18, and a fixing unit or an apparatus configured to fix an image and to smooth the image surface 25.

FIG. 3 shows the apparatus configured to fix an image and to smooth the image surface 25 or the fixing unit which is arranged inside the image forming apparatus 200 in FIG. 2.

As shown in FIG. 3, the apparatus configured to fix an image and to smooth the image surface 25 is equipped with a heat roller 71, a peeling roller 74, a tension roller 75, an endless belt 73 supported rotatably by the tension roller 75 and pressurizing roller 72 contacted by pressure to the heat roller 71 through the endless belt 73.

A cooling heatsink 77 which forces the endless belt 73 to cool is arranged inside the endless belt 73 between the heat roller 71 and the peeling roller 74. The cooling heatsink 77 constitutes a cooling and sheet-conveying unit for cooling and conveying the electrophotographic image-receiving sheet.

In the apparatus configured to fix an image and to smooth the image surface 25 as shown in FIG. 3, the electrophotographic image-receiving sheer bearing a color toner image transferred and fixed on its surface is introduced into a press-contacting portion (or nip portion) between the heat roller 71 and the pressurizing roller 72 contacted by being urged to the heat roller 71 through the endless belt 73 such that the color toner image in the image-receiving sheet faces to the heat roller 71, thus the color toner image is heated and fused on the electrophotographic image-receiving sheet while the electrophotographic image-receiving sheet passes through the press-contacting portion between the heat roller 71 and the pressurizing roller 72.

Thereafter, the electrophotographic image-receiving sheet bearing the color toner image fixed in the image-receiving layer of electrophotographic image-receiving sheet by heating the toner of the color toner image to a temperature of substantially from 120° C. to 130° C. at the press-contacting portion between the heat roller 71 and the pressurizing roller 72 is conveyed by the endless belt 73, while the toner image-receiving layer in the surface of electrophotographic image-receiving sheet adheres to the surface of the endless belt 73. When conveying the electrophotographic image-receiving layer 18, the endless belt 73 is forcedly cooled by the cooling heatsink 77 and the color toner image and the image-receiving layer are cooled and solidified so that the electrophotographic image-receiving layer is peeled from the endless belt 73 by the peeling roller 74 and own stiffness (nerve) of the electrophotographic image-receiving layer.

The surface of the endless belt 73 after the peeling step is cleaned by removing residual toners therefrom using a cleaner (not shown) and readied for the next step of fixing the image and smoothing the image surface.

The image forming method according to the present invention may ascertain the peeling ability of electrophotographic image-receiving sheets and toners, prevent offset of electrophotographic image-receiving sheets and toner components, achieve stable paper-feeding, and form high quality images like prints of silver-salt photography with superior surface condition and higher glossiness.

The present invention may solve the problems in the art, i.e. may provide an electrophotographic image-receiving sheet that can form highly glossy, high quality images with proper low-temperature toner fixability and excellent adhesion resistance; a method for producing an electrophotographic image-receiving sheet that can produce the sheet with aqueous coating, lower environmental load, lower cost and higher efficiency; and an image forming method by use of the electrophotographic image-receiving sheet.

Examples

The present invention will be explained with reference to Examples, to which the present invention is limited in no way. All percentages and parts are expressed by mass unless indicated otherwise.

Production Example 1

Preparation of Raw Paper

A broad-leaf kraft pulp (LBKP) was beaten to 300 ml of Canadian Standard Freeness using a disc refiner to adjust the fiber length into 0.58 mm. The additives were added to the resulting pulp paper material in the amounts shown in Table 2 based on the mass of the pulp.

TABLE 2

| Additive | Amount (% by mass) |
|---|---|
| Cation starch | 1.2 |
| Alkylketen dimer (AKD) | 0.5 |
| Anion polyacrylamide | 0.3 |
| Epoxidized fatty acid amide (EFA) | 0.2 |
| Polyamide polyamine epichlorohydrin | 0.3 |

In table 2, AKD indicates an alkylketene dimer of which the alkyl moiety is derived from a fatty acid based on behenic acid; EFA indicates an epoxidized fatty acid amide of which the fatty acid moiety is derived from a fatty acid based on behenic acid.

A raw paper of 160 g/m$^2$ was prepared from the pulp paper material using a Fourdrinier paper machine. In the process, 1.0 g/m$^2$ of polyvinyl alcohol (PVA) and 0.8 g/m$^2$ of $CaCl_2$ were added at around the center of a drying zone of the Fourdrinier paper machine using a size press device.

At the last of the paper making process, the density was adjusted to 1.01 g/cm$^3$ using a soft calender. The resulting raw paper was passed through a nip such that the side, on which a toner image-receiving layer is to be provided, contacts with a metal roll having a surface temperature of 140° C.

Production Example 2

Preparation of Support A

The resulting raw paper was treated with a corona discharge at output 17 kW, then the polyethylene resin of Formulation (a) in Table 3 was extrusion-laminated on the back side while ejecting a melted film at 320° C. and line speed 250 m/min by use of a cooling roll of surface matte roughness 10 μm, thereby to provide a back-side polyethylene resin layer of 20 μm thick.

Then the melted mixture of Formulation (c) shown in Table 3, containing a polyethylene resin and a master-batched titanium oxide of Table 4, was extrusion-laminated at 320° C. and line speed 250 m/min on the front surface of the raw paper, on which a toner image-receiving layer being formed, by use of a cooling roll of surface matte roughness 0.7 μm, thereby to provide a monolayer of a front-side polyethylene resin layer of 30 μm thick.

Thereafter, the front-side was treated with a corona discharge of 18 kW, the back-side was also treated with 12 kW, then an under coat layer of gelatin of dry mass 0.06 g/m$^2$ was provided on the front-side, and a back-side layer containing Snowtex® (Nissan Chemical Industries, Co.), an alumina sol and PVA in 0.075, 0.038 and 0.001 g/m$^2$ respectively was provided on the back side, thereby to prepare a support A.

Production Example 3

Preparation of Support B

The resulting raw paper was treated with a corona discharge at output 17 kW, then the polyethylene resin of Formulation (b) in Table 3 was extrusion-laminated on the back side while ejecting a melted film at 320° C. and line speed 250 m/min by use of a cooling roll of surface matte roughness 10 μm, thereby to provide a backside polyethylene resin layer of 25 μm.

Then the melted mixtures of Formulations (d) and (e) shown in Table 3, each containing a polyethylene resin and a master-batched titanium oxide of Table 4, were concurrently extrusion-laminated on the front surface of the raw paper, on which a toner image-receiving layer being formed, as the lower and the upper layers in each 15 μm thick and the melted mixture of Formulation (e) shown in Table 3, by use of a cooling roll of surface matte roughness 0.7 μm, thereby to provide a monolayer of a front-side polyethylene resin layer of 30 μm thick. Thereafter, a gelatin layer, an under-coat layer, and a back-side layer were provided on the front- and back-sides in a similar manner as the support A. Consequently, the support B was prepared.

TABLE 3

| | Resin property | | Formulation (% by mass) | | | | |
|---|---|---|---|---|---|---|---|
| | MFR | Density | | | | | |
| | g/10 min | g/cm$^3$ | a | b | c | d | e |
| HDPE | 15 | 0.968 | 55 | 70 | — | 70 | — |
| LDPE (A) | 3.5 | 0.924 | 45 | 30 | 70 | — | — |
| LDPE (B) | 15 | 0.919 | — | — | — | — | 70 |
| Master-batched titanium oxide | — | — | — | — | 30 | 30 | 30 |
| Average density of resin (g/cm$^3$) | — | — | 0.948 | 0.955 | 0.924 | 0.961 | 0.919 |

TABLE 4

| | Content (% by mass) |
|---|---|
| LDPE (density ρ = 0.921 g/cm$^3$) | 37.98 |
| Anataze titanium dioxide | 60 |
| Zinc stearate | 2 |
| Antioxidant | 0.02 |

Synthesis Example 1

Synthesis of Crystalline Polyester Resin P-1

A mixture of 253.6 g of dodecanedioate, 95.2 g of ethylene glycol, 0.7 g of trimethylol propane, and 0.11 g of tetra-n-butyl titanate was poured into a heat/pressure resistant glass container equipped with a stirrer, and the reactant was heated at 235° C. for 3 hours to be esterified. Then the pressure in the container was gradually reduced over 1 hour to 13 Pa. After 3 hours, the container was backfilled with nitrogen gas to normal pressure, then 10.4 g of trimellitic anhydride was added to the reactant, and the mixture was stirred for 1.5 hours to undergo a depolymerization reaction thereby to synthesize a crystalline polyester resin P-1.

Synthesis Example 2

Synthesis of Crystalline Polyester Resin P-2

A mixture of 65.2 g of sebacic acid, 107.9 g of succinic anhydride, 175.8 g of 1,4-butanediol, 1.0 g of trimethylol propane, and 0.14 g of tetra-n-butyl titanate was poured into a heat/pressure resistant glass container equipped with a stirrer, and the reactant was heated at 235° C. for 3 hours to be esterified. Then the pressure in the container was gradually reduced over 1 hour to 13 Pa. After 3 hours, the container was backfilled with nitrogen gas to normal pressure, then 9.9 g of trimellitic anhydride was added to the reactant, and the mixture was stirred for 1.5 hours to undergo a depolymerization reaction thereby to synthesize a crystalline polyester resin P-2.

Synthesis Example 3

Synthesis of Crystalline Polyester Resin P-3

A mixture of 143.7 g of sebacic acid, 78.6 g of terephthalic acid, 153.4 g of 1,4-butanediol, and 0.12 g of tetra-n-butyl titanate was poured into a heat/pressure resistant glass container equipped with a stirrer, and the reactant was heated at 235° C. for 3 hours to be esterified. Then the pressure in the container was gradually reduced over 1 hour to 13 Pa. After 3 hours, the container was backfilled with nitrogen gas to normal pressure, then 8.7 g of trimellitic anhydride was added to the reactant, and the mixture was stirred for 1.5 hours to undergo a depolymerization reaction thereby to synthesize a crystalline polyester resin P-3.

Synthesis Example 4

Synthesis of Amorphous Polyester Resin P-4

A mixture of 166.0 g of terephthalic acid, 36.0 g of ethylene glycol, 48.9 g of neopentyl glycol, and 94.8 g of 2,2-bis(4-hydroxyethoxyphenyl)propane was poured into a heat/pressure resistant glass container equipped with a stirrer, and the reactant was heated at 260° C. for 4 hours to be esterified. Then 79 mg of antimony trioxide and 49 mg of triethylphosphate were added to the reactant as a catalyst and the mixture was heated to 280° C. and the pressure in the container was gradually reduced over one hour into 13 Pa, then the container was backfilled with nitrogen gas to normal pressure after a polymerization reaction of 2 hours. Then the reactant was cooled to 250° C., to which 8.3 g of isophthalic acid was added, and the mixture was stirred for 2 hours to undergo a depolymerization reaction thereby to synthesize an amorphous polyester resin P-4.

Synthesis Example 5

Synthesis of Amorphous Polyester Resin P-5

A mixture of 99.6 g of terephthalic acid, 41.5 g of isophthalic acid, 21.9 g of adipic acid, and 31.0 g of ethylene glycol, and 88.4 g of neopentyl glycol was poured into a heat/pressure resistant glass container equipped with a stirrer, and the reactant was heated at 260° C. for 4 hours to be esterified. Then 79 mg of antimony trioxide and 49 mg of triethylphosphate were added to the reactant as a catalyst, then the mixture was heated to 280° C. and the pressure in the container was gradually reduced over one hour into 13 Pa, then the container was backfilled with nitrogen gas to normal pressure after a polymerization reaction of 2 hours. Then the reactant was cooled to 250° C., to which 5.25 g of trimellitic acid was added, and the mixture was stirred for 2 hours to undergo a depolymerization reaction thereby to synthesize an amorphous polyester resin P-5

The resulting crystalline polyester resins of P-1 to P-3 and amorphous polyester resins of P-4 and P-5 were evaluated in terms of various properties as follows. The results are shown in Table 5.

(i) Configuration of Polyester Resin

The configuration of the polyester resins was determined by use of $^{1}$H-NMR (300 MHz, by Varian Co.).

(ii) Number Average Molecular Mass of Polyester Resin

The molecular mass was determined by gel permeation analysis using a liquid-feed unit LC-10ADvp and a UV-visual spectrophotometer SPD-6AV (by Shimadzu Co.) under a condition of detecting wavelength 254 nm, solvent tetrahydrofuran, and polystyrene-equivalent conversion.

(iii) Acid Value of Polyester Resin

A polyester resin was dissolved in an amount of 0.5 g into a mixed solvent 50 ml of water and dioxane (1/9 by volume), and the solution was titrated using a KOH solution with cresol red as the indicator. The amount of KOH required to neutralize the solution in terms of mg KOH was determined as the acid value per gram of the polyester resin.

(iv) Melting Point and Glass Transition Temperature of Polyester Resin

The melting point of the polyester resin was measured using a differential scanning calorimeter (DSC7, by PerkinElmer Co.) in a way that a sample 10 mg was heated and analyzed for differential peaks at a rising rate of 20° C./min, and the peak top temperature during raising the temperature was defined as the melting point.

The glass transition temperature of the polyester resin was measure using the same apparatus described above at a rising rate of 10° C./min, and the first inflection value among the two inflection values due to glass transition in the temperature-controlled curve was defined as the glass transition temperature.

TABLE 5

| Ingredient (molar ratio) | | Crystalline polyester resin | | | Amorphous polyester resin | |
|---|---|---|---|---|---|---|
| | | P-1 | P-2 | P-3 | P-4 | P-5 |
| Acid ingredient | DDA | 100 | — | — | — | — |
| | SEA | — | 23 | 60 | — | — |
| | SUA | — | 77 | — | — | — |
| | TPA | — | — | 40 | 100 | 60 |
| | IPA | — | — | — | — | 25 |
| | ADA | — | — | — | — | 15 |
| Alcohol ingredient | EG | 99.5 | — | — | 35 | 30 |
| | BD | — | 99.5 | 100 | — | — |
| | TMP | 0.5 | 0.5 | — | — | — |
| | NPG | — | — | — | 35 | 70 |
| | BAEO | — | — | — | 30 | — |

TABLE 5-continued

| Ingredient (molar ratio) | | Crystalline polyester resin | | | Amorphous polyester resin | |
|---|---|---|---|---|---|---|
| | | P-1 | P-2 | P-3 | P-4 | P-5 |
| Depolymerizing agent | IPA | — | — | — | 5 | — |
| | TMA | 4.9 | 3.7 | 3.8 | — | 2.5 |
| Number average molecular mass | | 8,800 | 10,800 | 14,000 | 6,000 | 7,000 |
| Acid value (mgKOH/g) | | 25.0 | 29.4 | 23.4 | 17.1 | 18.1 |
| Melting point (° C.) | | 81.0 | 91.2 | 90.0 | — | — |
| crystal-melting heat (J/g) | | 89.1 | 63.0 | 43.0 | — | — |
| Cooling crystallization temperature (° C.) | | 53.0 | 33.2 | 28.5 | — | — |
| Glass transition temperature (° C.) | | — | — | — | 70 | 41 |

Abbreviations in Table 5 are specifically DDA: dodecanedioate, SEA: sebacic acid, SUA: succinic acid, TPA: terephthalic acid, IPA: isophthalic acid, ADA: adipic acid, EG: ethylene glycol, BD: 1,4-butanediol, TMP: trimethylolpropane, NPG: neopentyl glycol, BAEO: 2,2-bis(4-hydroxyethoxyphenyl)propane, and TMA: trimellitic acid.

Production Example 4

Preparation of Self-Dispersible Polyester Resin Emulsion S-1

A mixture of 200 g of the crystalline polyester resin P-1 and 467 g of methylethylketone was poured into a three necked round bottom flask of 3 liters, the flask was then immersed into a hot bath and the mixture was stirred to make a transparent liquid. After adding 27 g of triethylamine as a basic compound to the mixture while heating and stirring, 653 g of distilled water was added little by little to the reactant carefully so as to maintain uniformity, thereby causing a phase transformation and an emulsification. Then the flask and its content were placed on an oil bath at 85° C. with a condenser, and methylethylketone were distilled with water through azeotropy. The bath temperature was raised, while observing the distilling condition, to 120° C. at the last, and the heating was stopped when the distilled liquid came to 680.3 g, then the reactant was cooled to room temperature using a water bath. Then 2.6 g of 28% ammonium aqueous solution was added to the reaction product, the mixture was filtered through a wire screen of 600 mesh, thereby to a resin emulsion S-1.

Production Example 5

Preparation of Self-Dispersible Polyester Resin Emulsion S-2

A resin emulsion S-2 was prepared in the same manner as Production Example 4, except that the crystalline polyester resin P-1 was changed into the crystalline polyester resin P-2, the amount of triethylamine was 33 g, and the 28% ammonium aqueous solution at the last stage was added in an amount of 0.9 g.

Production Example 6

Preparation of Self-Dispersible Polyester Resin Emulsion S-3

A resin emulsion S-3 was prepared in the same manner as Production Example 4, except that the crystalline polyester resin P-1 was changed into the crystalline polyester resin P-3, the triethylamine of 27 g was changed into 15 g of 28% ammonium aqueous solution, and the 28% ammonium aqueous solution at the last stage was added in an amount of 0.9 g.

Production Example 7

Preparation of Self-Dispersible Polyester Resin Emulsion S-4

A mixture of 558.4 g of water, 135.0 g of isopropyl alcohol, 300 g of amorphous polyester resin P-4, and 6.4 g of 28% ammonium aqueous solution was poured into a three necked round bottom flask of 3 liters, the flask was then immersed into a hot bath and the mixture was heated to 70° C. while stirring. After one hour, 113.6 g of water was added to the mixture while continuing the stirring. Then a condenser was attached to the flask placed on a hot bath at 85° C., and isopropyl alcohol was distilled with water through azeotropy. The bath temperature was raised, while observing the distilling condition, to 120° C. at the last, and the heating was stopped when the distilled liquid came to 256.5 g, then the reactant was cooled to room temperature using a water bath. Then the liquid in the flask was filtered through a wire screen of 600 mesh, thereby to prepare a resin emulsion S-4 having a solid content of 30.0%.

Production Example 8

Preparation of Self-Dispersible Polyester Resin Emulsion S-5

A resin emulsion S-5 having a solid content of 30.0% was prepared in the same manner as Production Example 7, except that the amorphous polyester resin P-4 was changed into the amorphous polyester resin P-5.

The properties of polyester resin aqueous dispersions, i.e. self-dispersible polyester resin emulsions S-1 to S-5, are shown in Table 6.

TABLE 6

| | Polyester resin aqueous dispersion | | | | |
|---|---|---|---|---|---|
| | S-1 | S-2 | S-3 | S-4 | S-5 |
| Polyester resin | P-1 | P-2 | P-3 | P-4 | P-5 |
| Silid content of polyester resin (% by mass) | 30.0 | 29.7 | 29.4 | 30.0 | 30.0 |
| Dispersion condition | stable | stable | stable | stable | stable |

Example 1

Preparation of Electrophotographic Image-Receiving Sheet

Preparation of Titanium Dioxide Dispersion

The ingredients shown below were mixed and dispersed using a dispersing device (NBK-2, by Nippon Seiki Co.) to prepare a dispersion of titanium dioxide.

| | |
|---|---|
| Titanium dioxide (R-780-2)*1) | 48 parts |
| Polyvinyl alcohol (PVA205C, by Kuraray Co.) | 40 parts |
| Surfactant (Demol EP, by Kao Corporation) | 0.6 part |
| Deionized water | 31.6 parts |

*1)by Ishihara Industry Co.

The composition for toner image-receiving layer shown below was then coated on the support A using a wire coater, and dried at 90° C. for 2 minutes to form a toner image-receiving layer having a dry mass of 8 g/m$^2$. Consequently, the electrophotographic image-receiving sheet of Example 1 was produced.

Composition for Toner Image-Receiving Layer

| | |
|---|---|
| Self-dispersible polyester resin aqueous emulsion S-1 | 200 parts |
| Water | 128.7 parts |
| Titanium dioxide dispersion described above | 15.5 parts |
| Carnauba wax aqueous dispersion*1) | 10 parts |
| Polyethylene oxide (Alkox R1000)*2) | 4.8 parts |
| Anionic surfactant (Rapisol A90)*3) | 1.5 parts |

*1)Cellozol 524, by Chukyo Yushi Co.
*2)by Meisei Chemical Works, Ltd.
*3)by NOF Corporation Example 2

Preparation of Electrophotographic Image-Receiving Sheet

The electrophotographic image-receiving sheet of Example 2 was prepared in the same manner as Example 1, except that 200 parts of the self-dispersible polyester resin aqueous emulsion S-1 was changed into 100 parts of the self-dispersible polyester resin aqueous emulsion S-1 as well as 100 parts of the self-dispersible polyester resin aqueous emulsion S-4, and the blending ratio of the crystalline polymer and the amorphous polymer was changed into 50:50.

Example 3

Preparation of Electrophotographic Image-Receiving Sheet

The electrophotographic image-receiving sheet of Example 3 was prepared in the same manner as Example 1, except that 200 parts of the polyester resin aqueous emulsion S-1 was changed into 50 parts of the polyester resin aqueous emulsion S-1 as well as 150 parts of the polyester resin aqueous emulsion S-4, and the blending ratio of the crystalline polymer and the amorphous polymer was changed into 25:75.

Example 4

Preparation of Electrophotographic Image-Receiving Sheet

The electrophotographic image-receiving sheet of Example 4 was prepared in the same manner as Example 3, except that the polyester resin aqueous emulsion S-1 was changed into the polyester resin aqueous emulsion S-2.

Example 5

Preparation of Electrophotographic Image-Receiving Sheet

The electrophotographic image-receiving sheet of Example 5 was prepared in the same manner as Example 3, except that the polyester resin aqueous emulsion S-1 was changed into the polyester resin aqueous emulsion S-3.

Example 6

Preparation of Electrophotographic Image-Receiving Sheet

The electrophotographic image-receiving sheet of Example 6 was prepared in the same manner as Example 1, except that 200 parts of the self-dispersible polyester resin aqueous emulsion S-1 was changed into 20 parts of the self-dispersible polyester resin aqueous emulsion S-1 as well as 180 parts of the self-dispersible polyester resin aqueous emulsion S-4, and the blending ratio of the crystalline polymer and the amorphous polymer was changed into 10:90.

Example 7

Preparation of Electrophotographic Image-Receiving Sheet

The electrophotographic image-receiving sheet of Example 7 was prepared in the same manner as Example 6, except that the support A was changed into the support B.

Example 8

Preparation of Electrophotographic Image-Receiving Sheet

The electrophotographic image-receiving sheet of Example 8 was prepared in the same manner as Example 6, except that the support A was changed into the raw paper of Production Example 1, the composition for toner image-receiving layer was coated at a dry mass of 10 g/m$^2$ using a roll coater instead of the wire coater, and the coated wet film was attached and dried on a mirror-surface cast drum thereby to form an electrophotographic image-receiving sheet of cast coating type.

Comparative Example 1

Preparation of Electrophotographic Image-Receiving Sheet

The electrophotographic image-receiving sheet of Comparative Example 1 was prepared in the same manner as Example 1, except that the self-dispersible polyester resin aqueous emulsion S-1 was changed into the self-dispersible polyester resin aqueous emulsion S-4.

Comparative Example 2

Preparation of Electrophotographic Image-Receiving Sheet

The electrophotographic image-receiving sheet of Comparative Example 2 was prepared in the same manner as Example 1, except that the self-dispersible polyester resin aqueous emulsion S-1 was changed into the self-dispersible polyester resin aqueous emulsion S-5.

The resulting electrophotographic image-receiving sheets were evaluated in terms of phase separated structure in their toner image-receiving layers as follows. The results are shown in Table 8. The electrophotographic image-receiving sheets were also evaluated in terms of adhesion resistance, image defects such as edge voids and blister, and glossiness. The results are shown in Tables 8 and 9.

Evaluation of Phase Separated Structure in Toner Image-Receiving Layer

A toner image-receiving layer of the electrophotographic image-receiving sheets was scraped off in an amount of 10 mg, which was measured for endothermic peaks due to fusing of crystalline polyester around 82° C. through controlling form −20° C. to 150° C. at a heating rate of 10° C./min using a differential scanning calorimeter (DSC-Q1000, by TA instruments Co.). In addition, exothermic peaks due to crystallization of crystalline polyester were observed around 53° C. through controlling form 150° C. to −20° C. at a cooling rate of 10° C./min. The evaluation standard was as follows:

A: crystalline polyester maintains the phase separated structure in the toner image-receiving layer without losing the crystallinity due to phase-solubility of the crystalline polyester with other ingredients;

B: crystalline has no phase separated structure due to phase-solubility of the crystalline polyester with other ingredients.

Image Forming Condition

Image Formation

Using the fixing portion of the image forming apparatus (DocuCentre Color 500CP, by Fuji Xerox Co.) shown in FIG. 2 and the fixing portion shown in FIG. 3, images were formed on the resulting electrophotographic image-receiving sheets at 23° C. and 55% RH and fixed.

Belt:

belt support: a polyimide (PI) film of 50 cm wide and 80 μm thick;

material for belt release layer: a precursor for fluorocarbon siloxane rubber (SIFEL, by Shin-Etsu Chemical Co.) was vulcanized and cured to form a fluorocarbon siloxane rubber layer of 50 μm thick.

Step of Heating and Pressing temperature of heating roller: 120° C., 125° C. or 135° C.

nip pressure: 130 N/cm$^2$

Step of Cooling cooler: heatsink length 80 mm rate: 20 mm/sec

Evaluation of Adhesion Resistance

After conditioning at 40° C. and 80% RH for 24 hours, electrophotographic image-receiving sheets were overlapped such as contacting a surface of the toner image-receiving layer and a back surface of the electrophotographic image-receiving sheet, then the contacting area was imposed a load of 500 g on 3.5 cm square and allowed to stand at 40° C., 80% RH for 3 days. Then the contacting area of the electrophotographic image-receiving sheets was separated and evaluated under the following criteria, where A or B is a practically preferable level in the present invention.

Evaluation Criteria

A: no sound nor adhesion trace arises upon separation

B: slight sound and adhesion trace arise upon separation

C: adhesion trace remains on less than one quarter of contacting area

D: adhesion trace remains on from one quarter to one half of contacting area

E: adhesion trace remains on no less than one half of contacting area

Evaluation of Low Temperature Fixability

Using the image forming apparatus (DocuCentre Color 500CP, by Fuji Xerox Co.) described above, "x" indications were printed on A4 size electrophotographic image-receiving sheets, in a manner that black and red images were printed at upper left and lower light areas with each image containing five "x" marks vertically within an area of 1.8 cm square. Then the images were fixed by the fixing portion described above with controlling the temperature of the heating roller at 120° C. The defects at boundaries between toner images and non-image areas such as edge depressions and voids were evaluated visually under the criteria below, and the evaluation numbers were averaged with respect to red, black, upper left and lower right, where A, B or C (2 or less) is a practically preferable level in the present invention.

Evaluation Criteria 0 (A): no visible depressions 1 (B): about half "X" marks contain discontinuous depressions 2 (C): substantially all "X" marks contain discontinuous depressions 3 (D to C): substantially all "X" marks contain discontinuous depressions of about 2 mm at longest 4 (D): substantially all "X" marks contain discontinuous depressions of about 5 mm at longest Evaluation of Image Defect (Blister)

Using the image forming apparatus (DocuCentre Color 500CP) described above, a solid image of 10 cm square was formed at the highest density of black on A4 size electrophotographic image-receiving sheets with controlling the temperature of the heating roller at 135° C. Then defects observed as white dots within the toner black image were evaluated visually under the criteria below, where A or B is a practically preferable level in the present invention.

Evaluation Criteria

A: no defects like white dots within toner black image

B: some defects like white dots within toner black image

C: numerous defects like white dots over entire toner black image

Evaluation of Image Quality or Glossiness

Using the image forming apparatus (DocuCentre Color 500CP) described above, images of 1.8 cm square were printed at six black/white steps of 0%, 20%, 40%, 60%, 80% and 100% density. Then the images were fixed by the fixing portion described above with controlling the temperature of the heating roller at 125° C. The images were measured in terms of the glossiness at 20° using micro-TRI-gloss (by BYK Gardner GmbH), and the minimum values were evaluated under the following criteria.

Evaluation Criteria glossiness of 75 or more: very excellent glossiness of 70 or more: excellent glossiness of 60 or more: moderate glossiness of below 60: inferior

TABLE 7

| | Toner image receiving layer | | | | |
|---|---|---|---|---|---|
| | Crystalline polyester | Amorphous poyester | Mixing ratio (by mass) Crystalline | Mixing ratio (by mass) Amorphous | Support |
| Ex. 1 | S-1 | — | 100 | 0 | A |
| Ex. 2 | S-1 | S-4 | 50 | 50 | |
| Ex. 3 | S-1 | | 25 | 75 | |
| Ex. 4 | S-2 | | 25 | 75 | |
| Ex. 5 | S-3 | | 25 | 75 | |
| Ex. 6 | S-1 | | 10 | 90 | |
| Ex. 7 | S-1 | | 10 | 90 | B |
| Ex. 8 | S-1 | | 10 | 90 | Raw paper |
| Com. Ex. 1 | non | S-4 | 0 | 100 | A |
| Com. Ex. 2 | non | S-5 | 0 | 100 | |

TABLE 8

| | Evaluation | | | |
|---|---|---|---|---|
| | Adhesion resistance | Image defect | | Phase separation |
| | | Edge void | Blister | |
| Ex. 1 | A | A | B | A |
| Ex. 2 | A | B | B | A |
| Ex. 3 | A | B | B | A |
| Ex. 4 | A | B | B | A |
| Ex. 5 | A | B | B | A |
| Ex. 6 | A | C | B | A |
| Ex. 7 | A | C | A | A |
| Ex. 8 | A | C | A | A |
| Com. Ex. 1 | B | D | B | B |
| Com. Ex. 2 | E | C | B | B |

TABLE 9

| | Toner image-receiving layer | | | | |
|---|---|---|---|---|---|
| | Crystalline polyester | Amorphous poyester | Mixing ratio (by mass) | | Glossiness |
| | | | Crystalline | Amorphous | |
| Ex. 1 | S-1 | S-4 | 100 | 0 | inferior |
| Ex. 2 | | | 50 | 50 | inferior |
| Ex. 3 | | | 25 | 75 | excellent |
| Ex. 6 | | | 10 | 90 | very excellent |

The results of Table 8 demonstrate that the inventive aqueous dispersions of crystalline polyester resin may bring about electrophotographic image-receiving sheets that exhibit superior and well-balanced adhesion resistance and toner fixability free from image defects like edge voids.

The results of Table 9 demonstrate that mixing of a crystalline polyester resin aqueous dispersion and an amorphous polyester resin aqueous dispersion may bring about electrophotographic image-receiving sheets that exhibit higher glossiness and well-balanced other properties.

In addition, the results of Tables 7 and 8 demonstrate that when two or more layers of polyolefin resin exist at the side to dispose the toner image-receiving layer and the density of the outermost polyolefin resin layer at the distal site from raw paper is lower than the density of at least one polyolefin resin layer other than the outermost polyolefin resin layer, electrophotographic image-receiving sheets may be obtained that exhibit superior toner fixability free from image defects like blister and well-balanced other properties.

The electrophotographic image-receiving sheets according to the present invention may be produced from an aqueous coating liquid, which leads to less environmental load and lower cost in the production processes, and also may allow proper low-temperature toner fixability, excellent adhesion resistance, and high-gloss high-quality images, therefore, may favorably be used in various electrophotographic image forming apparatuses to form high gloss, high quality images like prints of silver-salt photography.

What is claimed is:

1. An electrophotographic image-receiving sheet, comprising: a support, and a toner image-receiving layer on at least one side of the support, wherein the toner image-receiving layer is formed from a coating liquid for the toner image-receiving layer, and the coating liquid for the toner image-receiving layer comprises an aqueous dispersion that comprises a crystalline polymer, wherein the toner image-receiving layer is formed from a coating liquid for toner image-receiving layer that comprises a crystalline polymer aqueous dispersion and an amorphous polymer aqueous dispersion, and the toner image-receiving layer exhibits a phase separated structure.

2. The electrophotographic image-receiving sheet according to claim 1, wherein the aqueous dispersion of the crystalline polymer comprises a basic compound and water.

3. The electrophotographic image-receiving sheet according to claim 1, wherein the crystalline polymer is a crystalline polyester resin.

4. The electrophotographic image-receiving sheet according to claim 3, wherein the crystalline polyester resin has a melting point of 50° C. to 110° C., a heat of crystal fusion of 60 Jig or more, and a crystallization temperature in the cooling stage of 30° C. or higher.

5. The electrophotographic image-receiving sheet according to claim 3, wherein the crystalline polymer has a carboxyl group and an acid value of 20 mg/KOH to 40 mg/KOH.

6. The electrophotographic image-receiving sheet according to claim 3, wherein the crystalline polyester resin is a condensation polymerization product of an acid and an alcohol, the acid is dodecanedioic acid, and the alcohol is ethylene glycol.

7. The electrophotographic image-receiving sheet according to claim 3, wherein the amorphous polymer is an amorphous polyester resin.

8. The electrophotographic image-receiving sheet according to claim 4, wherein the mass ratio of the amorphous polymer to the crystalline polymer is 95:5 to 50:50 (amorphous polymer:crystalline polymer) in the toner image-receiving layer.

9. The electrophotographic image-receiving sheet according to claim 1, wherein the support comprises a raw paper and at least a polyolefin resin layer on both sides of the raw paper.

10. The electrophotographic image-receiving sheet according to claim 9, wherein two or more layers of polyolefin resin exist at the front side to dispose the toner image-receiving layer, and the density of the outermost polyolefin resin layer at the distal site from the raw paper is lower than the density of polyolefin resin layer(s) other than the outermost polyolefin resin layer.

11. A method for producing an electrophotographic image-receiving sheet, comprising coating a liquid for a toner image-receiving layer on a support to form the toner image-receiving layer, wherein the liquid for the toner image-receiving layer comprises an aqueous dispersion of a crystalline polymer, a basic compound and water, and the toner image-receiving layer is formed from a coating liquid for toner image-receiving layer that comprises a crystalline polymer aqueous dispersion and an amorphous polymer aqueous dispersion.

12. The method for producing an electrophotographic image-receiving sheet according to claim 11, wherein the crystalline polymer is a crystalline polyester resin.

13. An image forming method, comprising:

forming a toner image on an electrophotographic image-receiving sheet, and smoothing the surface of the toner image, wherein the electrophotographic image-receiving sheet comprises a support and a toner image-receiving layer on at least one side of the support, and the toner image-receiving layer is formed from a coating liquid for the toner image-receiving layer, and the coating liquid for the toner image-receiving layer comprises an aqueous dispersion that comprises a crystalline polymer and an aqueous dispersion that comprises an amorphous polymer.

14. The image forming method according to claim 13, wherein the toner image is heated, pressed and cooled, and the electrophotographic image-receiving sheet is peeled by use of an image surface-smoothing and fixing device that comprises a heating/pressing member, a belt and a cooling unit.

* * * * *